US012102175B2

(12) United States Patent
Siegismund et al.

(10) Patent No.: US 12,102,175 B2
(45) Date of Patent: Oct. 1, 2024

(54) ARTICLE OF FOOTWEAR HAVING A SOLE PLATE WITH SPIKES

(71) Applicant: PUMA SE, Herzogenaurach (DE)

(72) Inventors: Andreas Siegismund, Rueckersdorf (DE); Romain Girard, Lauf an der Pegnitz (DE); Mauro Bonin, Nuremberg (DE)

(73) Assignee: PUMA SE, Herzogenaurach (DE)

( * ) Notice: Subject to any disclaimer, the term of this patent is extended or adjusted under 35 U.S.C. 154(b) by 9 days.

(21) Appl. No.: 17/682,692

(22) Filed: Feb. 28, 2022

(65) Prior Publication Data

US 2023/0270208 A1 Aug. 31, 2023

(51) Int. Cl.
*A43B 13/22* (2006.01)
*A43B 13/14* (2006.01)

(52) U.S. Cl.
CPC ..... *A43B 13/223* (2013.01); *A43B 13/146* (2013.01)

(58) Field of Classification Search
CPC ..... A43B 13/223; A43B 13/146; A43B 13/00; A43B 13/122; A43B 13/26; A43B 5/001; A43B 5/02
USPC ..... 33/25 R
See application file for complete search history.

(56) References Cited

U.S. PATENT DOCUMENTS 2,177,156 A * 10/1939 Shapiro ..... A43B 13/38 36/134
2,238,477 A * 4/1941 Murber ..... A43B 5/001 36/127
2,758,394 A * 8/1956 Whitlock ..... A43B 5/06 36/129
2,773,316 A * 12/1956 Clappier ..... A43C 13/12 36/129
3,273,266 A * 9/1966 Goldenberg ..... A43B 5/02 36/76 R
3,738,026 A * 6/1973 Granger ..... A43B 5/001 36/134
4,178,702 A * 12/1979 Mayer ..... A43C 15/164 36/67 D
4,212,120 A * 7/1980 Bowerman ..... A43B 5/06 36/129
4,315,374 A * 2/1982 Sneeringer ..... A43C 15/16 36/126

(Continued)

*Primary Examiner* — Heather Mangine
*Assistant Examiner* — Raquel M. Weis
(74) *Attorney, Agent, or Firm* — Quarles & Brady LLP

(57) ABSTRACT

A sole structure for an article of footwear includes an upper, an outsole, a sole plate, and a midsole structure. The sole plate is adjacent to the upper, the midsole structure is adjacent to the sole plate, and the outsole is adjacent to the midsole structure. An exposed forefoot region has the bottom wall of the sole plate uncovered by the outsole or midsole structure. A forward point and a rearward point are located along the bottom wall of the sole plate. The forward point is located at the front of the forefoot region and a rearward point is located farthest away from the forward point in the heel region. The forward point and the rearward point form a main axis line. The deepest point is the point located on the exterior of the outsole in the midfoot region that is not obstructed by midsole structure or outsole that can extend to form an inclination line to the forward point with respect to the main axis line at the highest angle. That angle is between 2 and 30 degrees.

20 Claims, 11 Drawing Sheets

(56) References Cited

U.S. PATENT DOCUMENTS 4,348,821 A * 9/1982 Daswick ..... A43B 13/24 36/114
4,527,345 A * 7/1985 Lopez Lopez ..... A43B 13/26 36/31
4,542,598 A * 9/1985 Misevich ..... A43B 13/16 36/31
4,559,724 A * 12/1985 Norton ..... A43B 5/06 36/114
4,562,651 A * 1/1986 Frederick ..... A43B 13/141 36/102
4,574,498 A * 3/1986 Norton ..... A43B 5/02 36/114
4,754,561 A * 7/1988 Dufour ..... A43B 13/188 36/31
4,782,604 A * 11/1988 Wen-Shown ..... A43B 13/26 36/134
4,837,949 A * 6/1989 Dufour ..... A43B 13/188 36/31
4,866,861 A * 9/1989 Noone ..... A43B 5/001 36/134
4,875,683 A * 10/1989 Wellman ..... A63B 69/3673 473/217
4,885,851 A * 12/1989 Peterson ..... A43B 3/0094 36/134
4,949,476 A * 8/1990 Anderie ..... A43B 5/06 36/114
5,077,916 A * 1/1992 Beneteau ..... A43B 13/184 36/31
5,339,544 A * 8/1994 Caberlotto ..... A43B 23/0255 36/43
5,392,537 A * 2/1995 Goldberg ..... A43B 13/14 36/134
5,483,760 A * 1/1996 Kataoka ..... A43C 15/02 36/129
5,533,282 A * 7/1996 Kataoka ..... A43B 13/26 36/129
5,706,589 A * 1/1998 Marc ..... A43B 13/182 36/27
5,775,010 A * 7/1998 Kaneko ..... A43B 13/26 36/129
5,829,172 A * 11/1998 Kaneko ..... A43B 13/026 36/108
5,873,184 A * 2/1999 Ihlenburg ..... A43B 13/26 36/126
6,061,931 A * 5/2000 Kaneko ..... A43B 5/06 36/129
6,826,852 B2 * 12/2004 Fusco ..... A43B 13/184 36/129
6,857,205 B1 * 2/2005 Fusco ..... A43B 13/141 36/31
6,973,746 B2 * 12/2005 Auger ..... A43B 1/0072 36/67 A
7,124,518 B1 * 10/2006 Brown ..... A43B 7/14 36/43
7,484,317 B2 * 2/2009 Kita ..... A43B 13/141 36/27
7,975,406 B2 * 7/2011 Suzuki ..... A43B 5/007 36/103
8,286,371 B2 * 10/2012 Baker ..... A43C 15/168 36/59 C
8,863,410 B2 * 10/2014 Schmid ..... A43C 15/161 36/134
9,532,623 B2 * 1/2017 Kilgore ..... A43B 13/14
9,700,103 B2 * 7/2017 Hatfield ..... A43C 15/02
9,930,934 B2 * 4/2018 Cook ..... A43B 13/141
10,314,367 B2 * 6/2019 Kilgore ..... A43B 13/122
10,595,587 B2 * 3/2020 Cook ..... A43B 13/16
10,750,817 B2 * 8/2020 Barnes ..... A43B 13/026
11,051,584 B2 * 7/2021 Foxen ..... A43B 13/12
2001/0049887 A1 * 12/2001 Ells, III ..... A43B 5/06 36/114
2002/0184793 A1 * 12/2002 Sato ..... A43B 13/12 36/114
2003/0167658 A1 * 9/2003 Davis ..... A43B 5/025 36/128
2003/0172548 A1 * 9/2003 Fuerst ..... A43B 13/026 36/28
2003/0208929 A1 * 11/2003 Lucas ..... A43B 3/0063 36/27
2004/0000074 A1 * 1/2004 Auger ..... A43B 13/12 36/102
2004/0064973 A1 * 4/2004 Talbott ..... A43B 7/145 36/114
2004/0107601 A1 * 6/2004 Schmid ..... A43B 13/181 36/28
2004/0181974 A1 * 9/2004 Robinson, Jr. ..... A43B 19/00 36/100
2005/0097782 A1 * 5/2005 Mills ..... A43B 5/02 36/126
2005/0097783 A1 * 5/2005 Mills ..... A43C 15/162 36/126
2005/0269010 A1 * 12/2005 Chi ..... A43C 15/161 156/60
2006/0042124 A1 * 3/2006 Mills ..... A43B 5/06 36/126
2006/0130361 A1 * 6/2006 Robinson, Jr. ..... A43B 13/10 36/102
2007/0256329 A1 * 11/2007 Antonelli ..... A43B 5/02 36/68
2007/0271818 A1 * 11/2007 Rabushka ..... A43B 13/187 36/38
2008/0072462 A1 * 3/2008 Fusco ..... A43C 15/168 36/103
2009/0119951 A1 * 5/2009 Hartveld ..... A43B 13/146 36/114
2013/0125421 A1 * 5/2013 Stegmaier ..... A43B 13/141 36/102
2013/0145656 A1 * 6/2013 Smith ..... A43B 23/0235 36/114
2013/0340295 A1 * 12/2013 Adami ..... A43B 13/04 12/146 B
2014/0013625 A1 * 1/2014 Grott ..... A43B 5/001 36/103
2015/0096195 A1 * 4/2015 Bacon ..... A43B 13/04 36/87
2015/0181974 A1 * 7/2015 Davis ..... A43B 7/1425 36/91
2015/0208755 A1 * 7/2015 Rustam ..... A43D 999/00 12/142 P
2015/0282557 A1 * 10/2015 Kirk ..... A43B 13/183 36/31
2016/0015120 A1 * 1/2016 Denison ..... A43B 3/0094 36/114
2016/0021977 A1 * 1/2016 Madore ..... A43B 13/12 36/30 R
2016/0174655 A1 * 6/2016 Schiller ..... A43B 13/22 156/60
2016/0309840 A1 * 10/2016 Lee ..... A43B 5/14
2016/0345668 A1 * 12/2016 Dyer ..... A43B 13/186
2017/0196305 A1 * 7/2017 Barnes ..... A43B 5/06
2017/0238656 A1 * 8/2017 Hurd ..... A43B 13/184
2018/0000191 A1 * 1/2018 Bacon ..... A43B 5/00
2018/0084862 A1 * 3/2018 Bacon ..... A43B 5/001
2018/0242688 A1 * 8/2018 Madore ..... A43B 13/223
2019/0246738 A1 * 8/2019 Connell ..... A43B 13/184
2019/0320759 A1 * 10/2019 Conrad ..... A43B 13/186
2021/0030112 A1 * 2/2021 Amoako ..... A43B 13/20
2021/0052037 A1 * 2/2021 Greenspan ..... A43B 13/186
2021/0120906 A1 * 4/2021 Donovan ..... A43B 23/0235
2021/0227929 A1 * 7/2021 Ni ..... A43B 13/37
2022/0022595 A1 * 1/2022 Girard ..... A43B 13/183
2022/0225729 A1 * 7/2022 Bonin ..... A43B 13/185
2023/0000207 A1 * 1/2023 Bonin ..... A43B 13/183
2023/0180888 A1 * 6/2023 Bonin ..... A43B 13/186 36/28

* cited by examiner

ARTICLE OF FOOTWEAR HAVING A SOLE PLATE WITH SPIKES

CROSS REFERENCE TO RELATED APPLICATIONS

Not applicable

REFERENCE REGARDING FEDERALLY SPONSORED RESEARCH OR DEVELOPMENT

Not applicable

SEQUENCE LISTING

Not applicable

BACKGROUND

1. Field of the Invention

The present disclosure relates generally to an article of footwear including a sole plate with spikes, and more particularly to a sole plate with spikes in a forefoot region that improves performance during various phases of a runner's footstep.

2. Description of the Background

Many conventional shoes or other articles of footwear generally comprise an upper and a sole attached to a lower end of the upper. Conventional shoes further include an internal space, i.e., a void or cavity, which is created by interior surfaces of the upper and the sole, which receives a foot of a user before securing the shoe to the foot. The sole is attached to a lower surface or boundary of the upper and is positioned between the upper and the ground. As a result, the sole typically provides stability and cushioning to the user when the shoe is being worn. In some instances, the sole may include multiple components, such as an outsole, a midsole, and an insole. The outsole may provide traction to a bottom surface of the sole, and the midsole may be attached to an inner surface of the outsole and may provide cushioning or added stability to the sole. For example, a sole may include a particular foam material that may increase stability at one or more desired locations along the sole, or a foam material that may reduce stress or impact energy on the foot or leg when a user is running, walking, or engaged in another activity. The sole may also include additional components, such as plates, embedded with the sole to increase the overall stiffness of the sole and reduce energy loss during use.

The upper generally extends upward from the sole and defines an interior cavity that completely or partially encases a foot. In most cases, the upper extends over the instep and toe regions of the foot, and across medial and lateral sides thereof. Many articles of footwear may also include a tongue that extends across the instep region to bridge a gap between edges of medial and lateral sides of the upper, which define an opening into the cavity. The tongue may also be disposed below a lacing system and between medial and lateral sides of the upper, to allow for adjustment of shoe tightness. The tongue may further be manipulable by a user to permit entry or exit of a foot from the internal space or cavity. In addition, the lacing system may allow a user to adjust certain dimensions of the upper or the sole, thereby allowing the upper to accommodate a wide variety of foot types having varying sizes and shapes.

The upper of many shoes may comprise a wide variety of materials, which may be utilized to form the upper and chosen for use based on one or more intended uses of the shoe. The upper may also include portions comprising varying materials specific to a particular area of the upper. For example, added stability may be desirable at a front of the upper or adjacent a heel region so as to provide a higher degree of resistance or rigidity. In contrast, other portions of a shoe may include a soft woven textile to provide an area with stretch-resistance, flexibility, air-permeability, or moisture-wicking properties.

Many runners experience energy losses or energy inefficiencies during running as a result of their footwear. When the runner's shoe initially contacts the ground, energy can be lost as the midsole in the front portion of the shoe is compressed. When the runner's shoe leaves contact with the ground, energy can be lost if the shoe loses traction. When the runner's shoe is in full contact with the ground, energy can be lost if the contact between the shoe and the ground is not strong. Also, the runner's shoe can impact the angle of inclination of the runner, which can also create lost energy.

However, in many cases, articles of footwear could benefit from having sole plates with spikes projecting from an exposed section in a forward or forefoot region of the shoe. The exposed section in the forefoot region of the shoe can create less energy loss when the runner's shoe initially contacts the ground. The exposed section in the forefoot region of the runner's shoe also facilitates a more forward angle of inclination, which can increase the energy efficiency of the runner. The spikes can help reduce energy losses by ensuring that the contact with the ground and the shoe is strong, and that traction is not lost.

SUMMARY

An article of footwear, as described herein, may have various configurations. The article of footwear may have an upper and a sole structure connected to the upper.

In some embodiments, the present disclosure can provide a sole structure for an article of footwear having an upper, a forefoot region, a midfoot region, a heel region, a medial side, and a lateral side. The sole structure has an outsole having an outsole wall located along an exterior of the outsole that is configured to be a ground-engaging surface. The sole structure has a sole plate positioned adjacent to the upper, having a bottom wall, a forward end, an exposed forefoot region, a front, a plurality of spikes, and a midsole structure positioned between the sole plate and the outsole. The forward end is located at the point in the forefoot region that is the farthest away from the heel region. The front is located at the forward end, and a forward point is located along the bottom wall and is located at the front. A rearward point is located along the bottom wall and is the point farthest away from the forward point. A main axis line is defined as a line that intersects the forward point and the rearward point. An exposed forefoot region is located in the forefoot region and is not covered by the outsole or the midsole structure.

The outsole wall has a deepest point in the midfoot region. The deepest point is defined as the point that forms the largest angle between the main axis line and an inclination line that is defined as a line that intersects the forward point and a point on the outsole wall that is not obstructed by the midsole structure or the outsole. The inclination angle is defined as the angle formed between the main axis line and the inclination line, and is between 2 and 30 degrees. In some embodiments, the inclination angle is between 3 and 20 degrees, or between 4 and 15 degrees, or between 5 and 10 degrees, and or between 6 and 8 degrees.

In some embodiments, a sole structure for an article of footwear has an upper, a forefoot region, a midfoot region, a heel region, a medial side, and a lateral side. The sole structure has an outsole having an outsole wall located along an exterior of the outsole that is configured to be a ground-engaging surface. The sole structure has a sole plate positioned adjacent to the upper, having a bottom wall, a forward end, an exposed forefoot region, a front, a plurality of spikes, and a midsole structure positioned between the sole plate and the outsole. An exposed forefoot region is located in the forefoot region and is not covered by the outsole or the midsole structure. The plurality of spikes are located in the exposed forefoot region.

An exposed forefoot edge defines the edge between the exposed forefoot region and the midsole structure or the outsole. The forward end is located in the forefoot region and is the farthest away from the heel region. The front is located at the forward end, and a forward point is located along the bottom wall and is located at the front. At least one of the plurality of spikes is located adjacent to the medial side and the exposed forefoot edge, at least one of the plurality of spikes is located adjacent to the lateral side and the exposed forefoot edge, and at least one of the plurality of spikes is located adjacent to the forward point. In some embodiments, the plurality of spikes has a first spike, a second spike, a third spike, and a fourth spike.

In some embodiments, the third spike and the fourth spike are located adjacent to the forward point. In some embodiments, the exposed forefoot region has a plurality of barbs, and each of the plurality of barbs is shorter than each of the plurality of spikes. In some embodiments, the front projects away from the bottom wall and toward the upper. In some embodiments, each of the plurality of spikes has an embossment that projects from the bottom wall and concentrically surrounds each of the plurality of spikes. In some embodiments, the midfoot region or the heel region has a cutout portion where the bottom wall is not covered by the midsole structure or the outsole.

In some embodiments, a sole structure for an article of footwear has an upper, a forefoot region, a midfoot region, a heel region, a medial side, and a lateral side. The sole structure has an outsole having an outsole wall located along an exterior of the outsole that is configured to be a ground-engaging surface. The sole structure has a sole plate positioned adjacent to the upper, having a bottom wall, a forward end, an exposed forefoot region, a front, a plurality of spikes, and a midsole structure positioned between the sole plate and the outsole. An exposed forefoot region is located in the forefoot region and is not covered by the outsole or the midsole structure. An exposed forefoot edge defines the edge between the exposed forefoot region and the midsole structure or the outsole. The forward end is located in the forefoot region and is the farthest away from the heel region. The front is located at the forward end, and a forward point is located along the bottom wall and is located at the front. A rearward point is located along the bottom wall and is the farthest away from the forward point.

A main axis line is defined as a line that intersects the forward point and the rearward point. The outsole wall has a deepest point in the midfoot region. The deepest point is defined as the point that forms the largest angle between the main axis line and an inclination line that is defined as a line that intersects the forward point and a point on the outsole wall that is not obstructed by the midsole structure or the outsole. A transition line is located along the bottom wall, projecting perpendicularly with respect to the main axis line, extending from the lateral side to the medial side, and is the closest to the deepest point. An undulating portion is defined as a region bounded by the transition line and the exposed forefoot edge, extending from the medial side to the lateral side. The sole structure within the undulating portion slopes toward the bottom wall.

In some embodiments, the front projects away from the bottom wall and toward the upper. In some embodiments, the exposed forefoot edge is a wavy continuous line. In some embodiments, the plurality of spikes are integrally formed with the sole plate. In some embodiments, the first spike is located adjacent to the exposed forefoot edge and the lateral side, and the second spike is located adjacent to the exposed forefoot edge and the medial side. In some embodiments, the third spike, and the fourth spike are located adjacent to the forward point.

Other aspects of the article of footwear, including features and advantages thereof, will become apparent to one of ordinary skill in the art upon examination of the figures and detailed description herein. Therefore, all such aspects of the article of footwear are intended to be included in the detailed description and this summary.

DETAILED DESCRIPTION OF THE DRAWINGS

Figure 1:
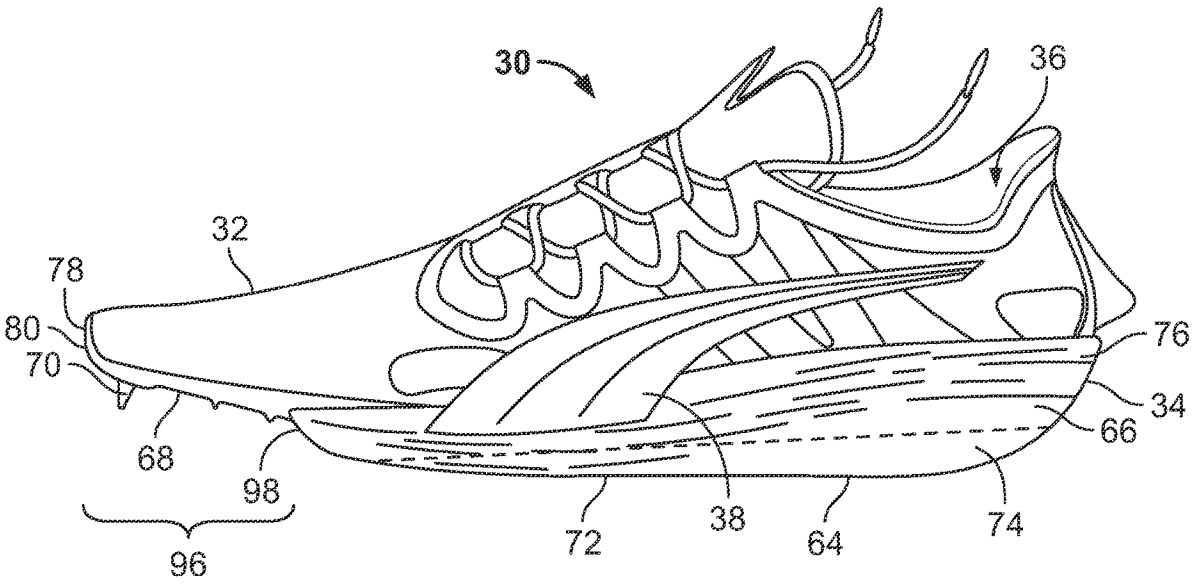
FIG. 1 is a lateral side view of an article of footwear configured as a left shoe that includes an upper and a sole structure according to an embodiment of the disclosure.

The following discussion and accompanying figures disclose various embodiments of a shoe or article of footwear, e.g., a running shoe, tennis shoe, basketball shoe, etc., and concepts associated with embodiments of the shoe and sole structure thereof may be applied to a wide range of footwear and footwear styles, including cross-training shoes, football shoes, lifestyle shoes, golf shoes, hiking shoes, hiking boots, ski and snowboard boots, soccer shoes and cleats, walking shoes, and track cleats, for example. Concepts of the shoe or the sole structure described herein may also be applied to articles of footwear that are considered non-athletic, including dress shoes, sandals, loafers, slippers, and heels.

The term "about," as used herein, refers to variation in the numerical quantity that may occur, for example, through typical measuring and manufacturing procedures used for articles of footwear or other articles of manufacture that may include embodiments of the disclosure herein; through inadvertent error in these procedures; through differences in the manufacture, source, or purity of the ingredients used to make the compositions or mixtures or carry out the methods; and the like. Throughout the disclosure, the terms "about" and "approximately" refer to a range of values±5% of the numeric value that the term precedes.

The terms "weight percent," "wt-%," "percent by weight," "% by weight," and variations thereof, as used herein, refer to the concentration of a substance or component as the weight of that substance or component divided by the total weight, for example, of the composition or of a particular component of the composition, and multiplied by 100. It is understood that, as used herein, "percent," "%," and the like may be synonymous with "weight percent" and "wt-%."

The present disclosure is directed to an article of footwear and/or specific components of the article of footwear, such as an upper and/or a sole or sole structure. The upper may comprise a knitted component, a woven textile, and/or a non-woven textile. The knitted component may be made by knitting of yarn, the woven textile by weaving of yarn, and the non-woven textile by manufacture of a unitary non-woven web. Knitted textiles include textiles formed by way of warp knitting, weft knitting, flat knitting, circular knitting, and/or other suitable knitting operations. The knit textile may have a plain knit structure, a mesh knit structure, and/or a rib knit structure, for example. Woven textiles include, but are not limited to, textiles formed by way of any of the numerous weave forms, such as plain weave, twill weave, satin weave, dobbin weave, jacquard weave, double weaves, and/or double cloth weaves, for example. Non-woven textiles include textiles made by air-laid and/or spun-laid methods, for example. The upper may comprise a variety of materials, such as a first yarn, a second yarn, and/or a third yarn, which may have varying properties or varying visual characteristics.

The word "runner" used herein should not be interpreted in a narrow sense, but encompasses activities including but not limited to shuffling, walking, hopping, jumping, leaping, skipping, jogging, running, and sprinting. The word "runner" is defined herein as a person taking a footstep, regardless of their horizontal speed. A footstep begins when the shoe contacts the ground, and ends when the shoe leaves contact with the ground. A runner then takes a stride and moves the shoe forward to begin the next footstep.

Figure 2:
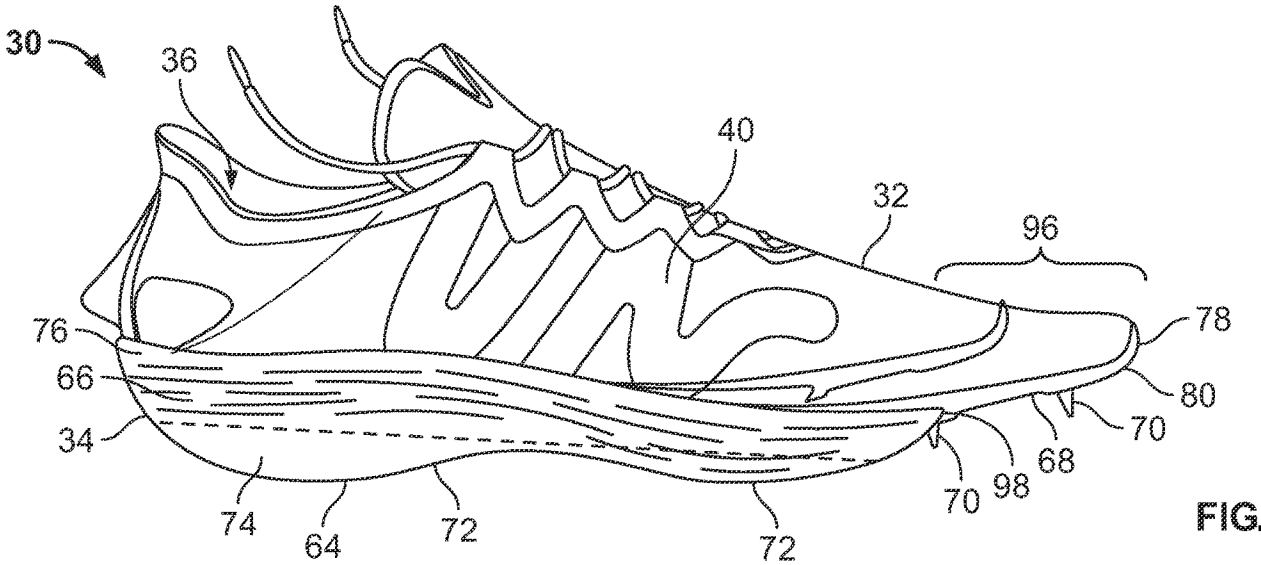
FIG. 2 is a medial side view of the shoe of FIG. 1.

FIGS. 1 and 2 depict an embodiment of an article of footwear or shoe 30, configured as a left shoe, which includes an upper 32 and a sole structure 34. The upper 32 is attached to the sole structure 34 and together define an interior cavity 36 into which a foot may be inserted. The article of footwear 30 also includes a lateral side 38 as illustrated in FIG. 1 and a medial side 40 as illustrated in FIG. 2. When a user is wearing the article of footwear 30, the lateral side 38 corresponds to an outside-facing portion of the article of footwear 30. In other words, the lateral side 38 is the side of the shoe 30 that is the most distal from the other shoe 30. The medial side 40 corresponds to an inside-facing portion of the article of footwear 30. In other words, the medial side 40 is the side of the shoe that is faces the other shoe. As such, left and right articles of footwear have opposing lateral and medial sides, such that the medial sides 40 are closest to one another when a user is wearing the articles of footwear 30, while the lateral sides 38 are defined as the sides that are farthest from one another while being worn. The medial side 40 and the lateral side 38 adjoin one another at opposing, distal ends of the article of footwear 30.

While only a single article of footwear 30 is depicted, i.e., a shoe that is worn on a left foot of a user, it should be appreciated that the concepts disclosed herein are applicable to a pair of shoes (not shown), which includes a left shoe and a right shoe that may be sized and shaped to receive a left foot and a right foot of a user, respectively. For ease of disclosure, a single shoe 30 will be referenced to describe aspects of the disclosure. The disclosure below with reference to the article of footwear 30 is applicable to both a left shoe and a right shoe. However, in some embodiments there may be differences between a left shoe and a right shoe other than the left/right configuration. Further, in some embodiments, a left shoe may include one or more additional elements that a right shoe does not include, or vice versa.

Figure 5:
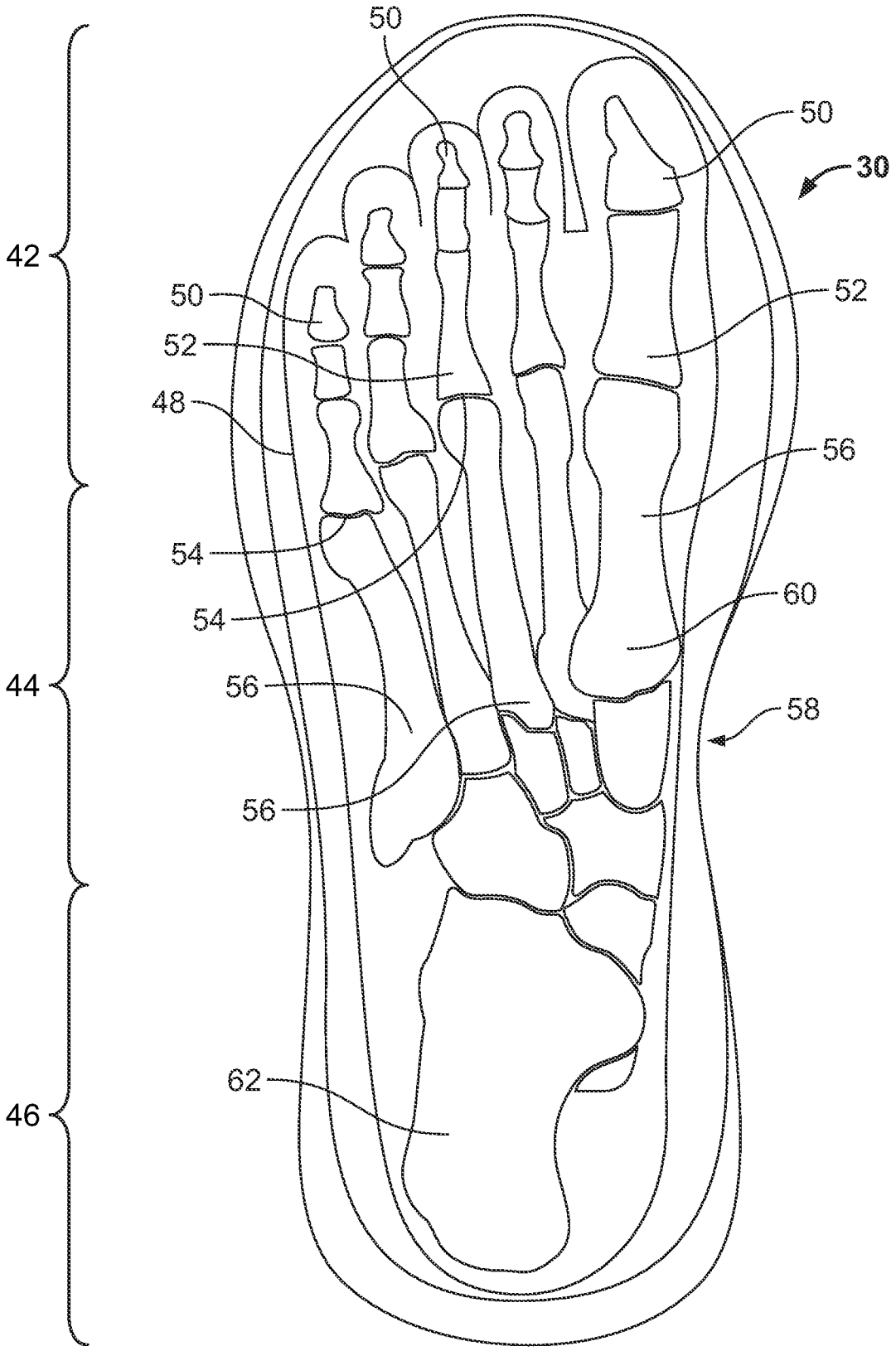
FIG. 5 is a top plan view of the article of footwear of FIG. 1, with an upper removed and a user's skeletal foot structure overlaid thereon.

FIG. 5 illustrates a schematic top view of the article of footwear 30, which defines a forefoot region 42, a midfoot region 44, and a heel region 46. The forefoot region 42 generally corresponds with portions of the article of footwear 30 that encase portions of a foot 48 that include a set of toes or phalanges 50, a ball 52 of the foot 48, and a set of joints 54 connecting a set of metatarsals 56 with the set of toes 50. The midfoot region 44 is adjacent to and adjoining the forefoot region 42, and generally corresponds with portions of the article of footwear 30 that encase an arch 58 of the foot 48, along with a bridge 60 of the foot 48. The heel region 46 is adjacent to and adjoining the midfoot region 44 and generally corresponds with portions of the article of footwear 30 that encase rear portions of the foot 48, including a heel or calcaneus bone 62, an ankle (not shown), and/or an Achilles tendon (not shown).

Unless otherwise specified, the forefoot region 42, the midfoot region 44, the heel region 46 (see FIG. 5), the medial side 40, and the lateral side 38 (see FIGS. 1 and 2) are intended to define boundaries or areas of the article of footwear 30. To that end, the forefoot region 42, the midfoot region 44, the heel region 46, the medial side 40, and the lateral side 38 generally characterize sections of the article of footwear 30. Further, both the upper 32 and the sole structure 34 may be characterized as having portions within the forefoot region 42, the midfoot region 44, the heel region 46, and on the medial side 40 and the lateral side 38. Therefore, the upper 32 and the sole structure 34 (see FIGS. 1 and 2), and/or individual portions of the upper 32 and the sole structure 34, may include portions thereof that are disposed within the forefoot region 42, the midfoot region 44, the heel region 46, and on the medial side 40 and the lateral side 38.

Referring again to FIGS. 1 and 2, the sole structure 34 includes an outsole 64, a midsole structure 66, and a sole plate 68 with a plurality of spikes 70. In some embodiments, an insole (not shown) is disposed between the midsole structure 66 and the upper 32. The outsole 64 has an outer or bottom wall 72 that is located on an exterior side of the outsole 64 and is configured to contact the ground or running surface. In some embodiments, the midsole structure 66 can include a first midsole member 74 that is adjacent to the outsole 64 and a second midsole member 76 that is adjacent to the first midsole member 74 and the sole plate 68. The sole plate 68 is adjacent to the upper 32, located generally between the midsole structure 66 and the upper 32. In some embodiments, the insole is positioned between the sole plate 68 and the upper 32. In some embodiments, the upper 32 can be secured to the insole in whole or in part.

Many conventional footwear uppers are formed from multiple elements (e.g., textiles, polymer foam, polymer sheets, leather, and synthetic leather) that are joined through bonding or stitching at a seam. In some embodiments, the upper 32 of the article of footwear 30 is formed from a knitted structure or knitted components. In various embodiments, a knitted component may incorporate various types of yarn that may provide different properties to an upper. For example, one area of the upper 32 may be formed from a first type of yarn that imparts a first set of properties, and another area of the upper 32 may be formed from a second type of yarn that imparts a second set of properties. Using this configuration, properties of the upper 32 may vary throughout the upper 32 by selecting specific yarns for different areas of the upper 32. In another example, an upper mesh layer may be warp knit, while a mesh backing layer may comprise a circular knit.

Still referring to FIGS. 1 and 2, the upper 32 can be secured to the sole plate 68 in whole or in part. The sole plate 68 of FIG. 1 further includes a rounded front 78 (see FIGS. 1 and 4) that projects toward the upper 32 at a forward end 80 of the sole plate 68 in the forefoot region 42. The forward end 80 is the point (or points) the farthest away from the heel region. Said another way, the forward end 80 is the most distal portion of the sole plate 68 to the heel region 46, which could comprise a point, an edge, or one or more regions. The first midsole member 74 may be constructed from a thermoplastic material, such as polyurethane (PU) plastic, for example, and the second midsole member 76 may be constructed from ethylene-vinyl acetate (EVA), copolymers thereof, or a similar type of material. In other embodiments, each of the first midsole member 74 and the second midsole member 76 may be constructed from the same material. In other embodiments, the first midsole member 74 and/or the second midsole member 76 may be an EVA-Solid-Sponge ("ES S") material, an EVA foam (e.g., PUMA® ProFoam Lite™, IGNITE Foam), polyurethane, polyether, an olefin block copolymer, a thermoplastic material (e.g., a thermoplastic polyurethane, a thermoplastic elastomer, a thermoplastic polyolefin, etc.), or a supercritical foam. The first midsole member 74 and/or the second midsole member 76 may be a single polymeric material or may be a blend of materials, such as an EVA copolymer, a thermoplastic polyurethane, a polyether block amide (PEBA) copolymer, and/or an olefin block copolymer.

Figure 3:
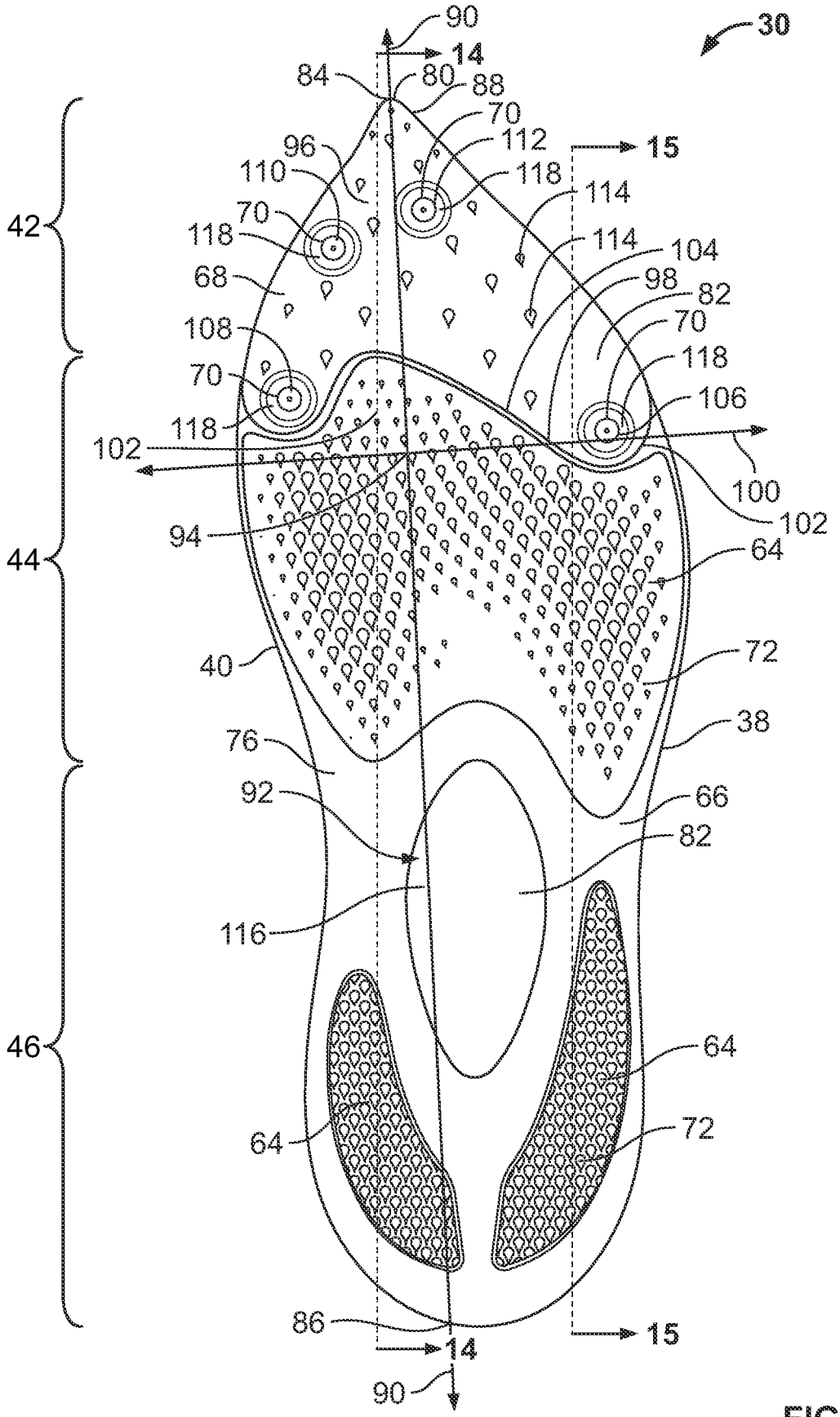
FIG. 3 is a bottom view of the shoe of FIG. 1.
Figure 4:
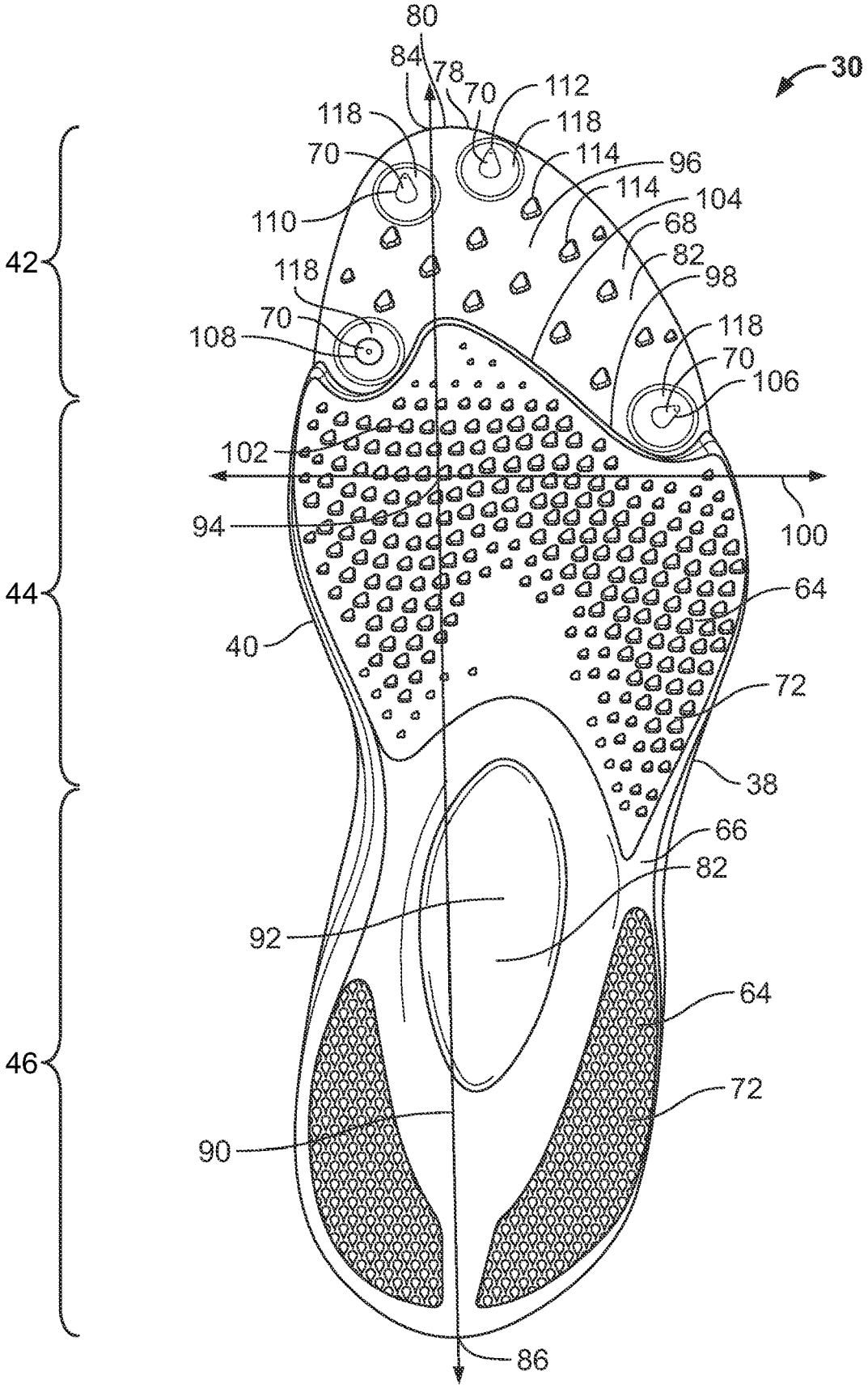
FIG. 4 is a bottom view of a second embodiment of the shoe of FIG. 1.

Still referring to FIGS. 1 and 2, in some embodiments, the sole plate 68 comprises a polyurethane (PU) plastic, such as a thermoplastic polyurethane (TPU) material, for example. Other thermoplastic elastomers and fiber reinforced thermoplastics consisting of block copolymers are also possible. In other embodiments, the sole plate 68 can include carbon fiber, for example. In some embodiments, these and other rigid, semi-rigid, or spring-like materials and combinations thereof may comprise the sole plate 68. The sole plate 68 can have varied stiffness and shape along the length of the sole plate 68. For example, the stiffness in the forefoot region 42 (the forefoot region 42, the midfoot region 44, and the heel region 46 are shown in FIGS. 3-5 for clarity) of the sole plate 68 may be more or less flexible than the midfoot region 44 of the sole plate 68, which may be more or less flexible than the heel region 46 of the sole plate 68. Alternatively, the sole plate 68 can include a uniform stiffness. Additionally, the sole plate 68 may include additional or alternative geometries, such as, for example, notches, curves, protrusions, voids, angled edges, cutouts, etc. In some embodiments, the sole plate 68 can be configured as a shock plate to impart impact protection and facilitate leg muscle tension, thereby relieving stress on a heel, ankle, shin, knees, hips, and/or back of a user. Due to the spring-like features of the materials chosen to make the sole plate 68, the sole plate 68 is suitable for providing a return or spring back force during each footstep as the sole plate 68 is first compressed, and then later released from the impact of a footstep.

The sole plate 68 provides for a rigid sole that can promote a faster takeoff when running. In particular, the shape and rigidity of the sole plate 68 acts as a propulsion lever between the midfoot region 44 and the heel region 46 of the wearer that allows the wearer to accelerate faster and create a toe off movement where the forefoot region 42 of the wearer propels the wearer forward. Further, embodiments of the sole structures described herein can provide a training aid or tool that can be used to strengthen entire leg and foot muscles of a wearer and adjust their running posture to a forward-tilt position that promotes constant muscle tension.

Still referring to FIGS. 1 and 2, the sole structure 34 is connected or secured to the upper 32 and extends between a foot of a user and the ground when the article of footwear 30 is worn by the user. The sole structure 34 may include one or more components, which may include the outsole 64, the midsole structure 66, a heel (not shown), a vamp (not shown), and/or the insole (not shown). For example, in some embodiments, the sole structure 34 may include the outsole 64 that provides structural integrity to the sole structure 34, along with traction for a user, the midsole structure 66 that provides a cushioning system, and the insole that provides support for the arch 58 of a user (see FIG. 5). As will be further discussed herein, the sole structure 34 of the present embodiment includes one or more components that provide the sole structure 34 with preferable spring and damping properties. In addition, the sole structure 34 of the present embodiment comprises the sole plate 68 with the plurality of spikes 70 for better traction and structure to improve the angle of inclination of the runner while taking a footstep.

FIGS. 3 and 4 illustrate first and second embodiments of the sole plate 68, and therefore the sole structure 34, of the article of footwear 30. FIG. 4 illustrates a rounded front 78 at a forward end 80 of the sole plate 68. The rounded front 78 extends in the direction of the upper 32 (see FIG. 7), and away from a bottom wall 82 of the sole plate 68. A forward point 84 is defined as the point along the bottom wall 82 that is located closest to the rounded front 78. In other words, the forward point 84 is generally the most forward point of the bottom wall 82 in the forefoot region 42. A rearward point 86 is defined as the point on the bottom wall 82 of the sole plate 68 that is located the farthest away or most distal from the forward point 84. In other words, the rearward point is generally the most rearward point of the bottom wall 82 in the heel region 46.

FIG. 3 illustrates a pointed front 88. The pointed front 88 of FIG. 3 and the rounded front 78 of FIG. 4 are each formed as an integral portion of the sole plate 68. A main axis 90 is defined as a line that intersects the forward point 84 and the rearward point 86 (see FIG. 3). The pointed front 88 is more suitable for races that have fewer curves or turns, and the rounded front 78 is more suitable for races that have more curves or turns. Referring to FIGS. 3 and 4, the midsole structure 66 and the outsole 64 generally cover the sole plate 68 along the bottom wall 82 in the midfoot region 44 and the heel region 46. In some embodiments, the midfoot region 44, the heel region 46, or both regions may have a cutout portion 92 where the bottom wall 82 of the sole plate 68 is not covered by midsole structure 66 or the outsole 64. The midsole structure 66 defines the cutout portion 92. The bottom wall 82 of the sole plate 68 is exposed at the cutout portion 92. The outsole 64 may be formed from one or more materials to impart durability, wear-resistance, abrasion resistance, or traction to the sole structure 34. In some embodiments, the outsole 64 may be formed from rubber, for example.

Figure 7:
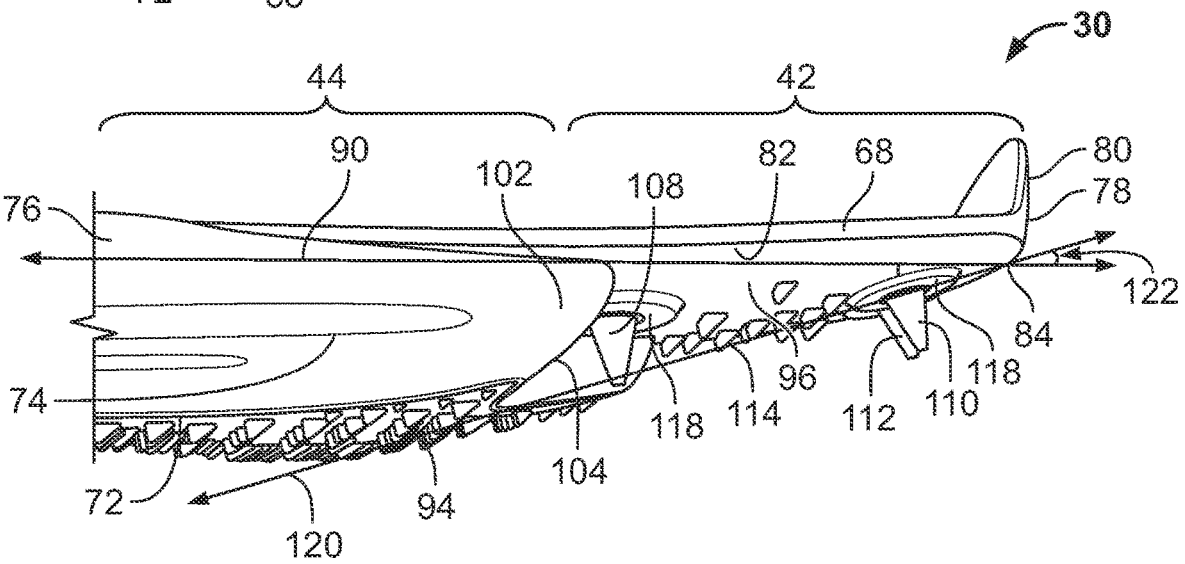
FIG. 7 is a side view of the underside of the shoe of FIG. 1.

Referring to FIGS. 3, 4, and 7, the bottom wall 72 has a deepest point 94 in the midfoot region 44. The deepest point 94 is defined as the point on the bottom wall 72 in the midfoot region 44 that forms the largest angle with respect to the forward point 84 about the main axis 90, and which is located farthest from the forward point 84 and is not obstructed by the midsole structure 66 or the outsole 64 along a line formed between the deepest point 94 and the forward point 84 (see FIG. 15). The deepest point 94 may be the lowest spot on the bottom wall 72 in the midfoot region 44; however the present embodiment depicts the deepest point 94 adjacent the lowest spot on the bottom wall 72. The bottom wall 82 of the sole plate 68 is not limited to being a flat surface, and may comprise contours or undulations or other configurations.

Referring to FIGS. 3 and 4, from the rounded front 78 or the pointed front 88 to at least a portion of the forefoot region 42, the bottom wall 82 of the sole plate 68 is not covered by midsole structure 66 or by the outsole 64. This exposed region of the bottom wall 82 of the sole plate 68 in the forefoot region 42 is defined as an exposed forefoot region 96. The boundary where the exposed forefoot region 96 ends and the bottom wall 82 of the sole plate 68 begins to be covered by either the outsole 64, the midsole structure 66, or both, is defined as an exposed forefoot edge 98. The exposed forefoot edge 98 may be a straight line, a wavy line, a jagged line, a contoured line, or any style of continuous line that reaches from the medial side 40 of the shoe 30 to the lateral side 38 of the shoe 30. A transition line 100 extends from the medial side 40 to the lateral side 38 of the shoe 30 along the bottom wall 82 of the sole plate 68, projecting perpendicular to the main axis 90, and positioned the closest to the deepest point 94. In other words, the transition line 100 extends from the lateral side 38 to the medial side 40 of the shoe 30 through the deepest point 94 when viewed from above.

The midfoot region 44 and the forefoot region 42 are further defined by a transition zone 102. The transition zone 102 is the region bounded by the exposed forefoot edge 98 at a first end, and by the transition line 100 at a second end. In FIG. 3, the transition zone 102 near the lateral edge 38 has the exposed forefoot edge 98 farther away from the forward point 84 than the transition line 100. However, the transition zone 102 near the medial edge 40 has the exposed forefoot edge 98 closer to the forward point 84 than the transition line 100. In other words, the transition zone 102 can have various segments, but each segment slopes toward the bottom wall 82 of the sole plate 68. The transition zone 102 spans from the medial side 40 of the shoe 30 to the lateral side 38 of the shoe 30. Since the deepest point 94 is a point along the bottom wall 72 of the outsole 64 in the midfoot region 44 (with respect to a line drawn from the forward point 84), and the forward point 84 is located on the bottom wall 82 of the sole plate 68, the sole structure 34 in the transition zone 102 slopes toward (up or down, depending upon the view) the bottom wall 82 to define an undulating portion 104 of the forward end of the outsole 64 and the midsole structure 66.

Comparing FIG. 4 with FIG. 3, the deepest point 94 is farther away from the forward point 84 in FIG. 4 than in FIG. 3. This difference in the location of the deepest point 94 leads to a difference in the respective transition zones 102 of FIG. 3 versus FIG. 4. In FIG. 4, the transition zone 102 is a single segment that is bounded by the exposed forefoot edge 98 which is closer to the forward point 84 than the transition line 100 is to the forward point 84, and bounded along the sides by the lateral side 38 and the medial side 40. Again, the transition zone 102 slopes toward the bottom wall 82 of the sole plate 68 along the undulating portion 104. FIGS. 3 and 4 show how the location of the deepest point 94 can influence the size and shape of the transition zone 102.

Referring to FIGS. 1-5, the undulating portion 104 and the plurality of spikes 70 (see FIGS. 3 and 4) are helpful in that they can provide improvements to a runner's performance. The article of footwear 30 shown in FIG. 1 has characteristics that are designed to help a runner run faster, especially during a high-speed race (e.g. during a 10 kilometer race). First, the plurality of spikes 70 in the forefoot region 42 improve the gripping to the ground during different phases of a runner's footstep, as will be discussed in more detail when discussing FIGS. 6-13. The location of each of the plurality of spikes 70 is chosen or identified to enhance a runner's performance during different phases of a runner's footstep. Second, as the sole plate 68 has less depth than the sole structure 34 of the midfoot region 44, the shoe 30 naturally facilitates an increase in a runner's angle of inclination, which improves running performance as well. In general terms, the faster a runner moves, the higher the angle of inclination within a certain range helps improve the runner's acceleration, and therefore speed (see the discussion of FIG. 8 below).

Referring specifically to FIGS. 3 and 4, the plurality of spikes 70 are located in the exposed forefoot region 96 of the forefoot region 42. The plurality of spikes 70 project away from the upper 32 along the bottom wall 82 of the sole plate 68. The plurality of spikes 70 are protuberances that have a deeply tapered or spike shape, and may be integrally formed with the sole plate 68, overmolded (not shown) into a corresponding plurality of apertures (not shown), or may have a threaded end (not shown) that is secured into corresponding threads (not shown) in the corresponding plurality of apertures. The plurality of spikes 70 can be made of a rigid plastic material or a metallic material. In some embodiments, the plurality of spikes 70 include a first spike 106, a second spike 108, a third spike 110, and a fourth spike 112. In some embodiments, each of the plurality of spikes 70 are identical. In other embodiments, one, some, or all of the plurality of spikes 70 can be varied from one another in shape, in size, or in material.

Still referring to FIGS. 3 and 4, in addition to the plurality of spikes 70 in the exposed forefoot region 96, the exposed forefoot region 96 may also have a plurality of barbs 114 (see also FIGS. 6 and 7) as well as, or alternatively, a plurality of teeth (not shown). The plurality of barbs 114 are formed integrally with the bottom wall 82 of the sole plate 68. Each of the plurality of barbs 114 is shorter in height than each of the plurality of spikes 70, which collectively enhance the gripping and traction to the ground. The plurality of barbs 114 are generally circular in cross section, the cross section taken parallel with the bottom wall 82, while the plurality of teeth are generally oval in cross section.

As shown in FIG. 3, the sole plate 68 extends at least partially through the midfoot region 44. In some embodiments the sole plate 68 is exposed at the cutout portion 92 as well as at the exposed forefoot region 96 of the forefoot region 42. In some embodiments, the sole plate 68 is disposed adjacent an arched section 116 of the article of footwear 30. In other embodiments, the ground-engaging surface is not continuous along the medial side 40 of the midfoot region 44 of the article of footwear 30. For example, as illustrated in FIG. 3, the outsole 64 partially surrounds the arched section 116, and the midsole structure 66 partially defines the arched section 116. The arched section 116 can be viewed as the area of transition from the cutout portion 92 to the bottom wall 72.

Figure 6:
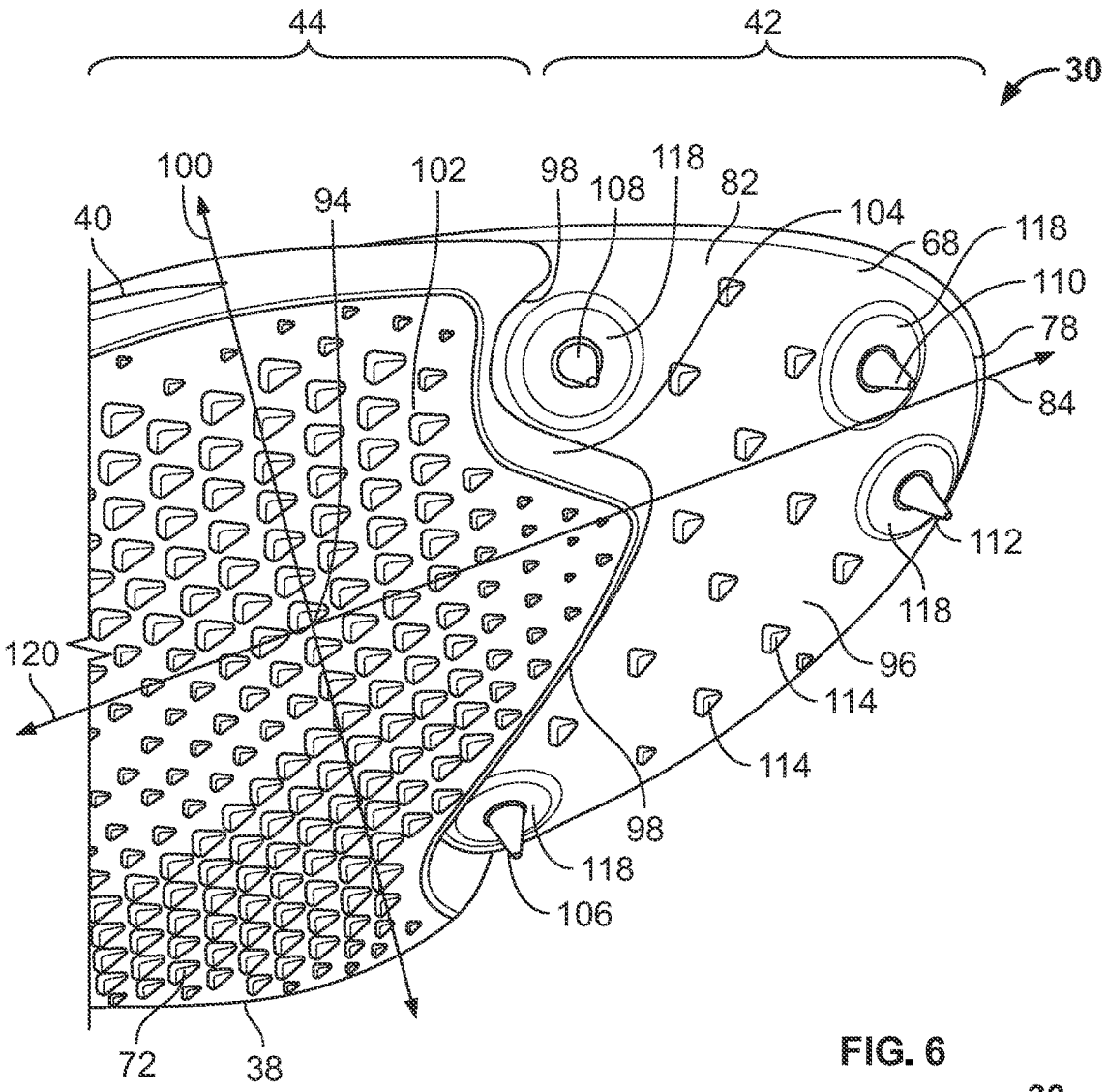
FIG. 6 is a bottom perspective view of an underside of the shoe of FIG. 1.

In FIG. 6, the forefoot region 42 is shown in its entirety, along with a portion of the midfoot region 44. The exposed forefoot region 96 and the exposed forefoot edge 98 expose or uncover the bottom wall 82 of the sole plate 68. The forward point 84, the deepest point 94, and the transition line 100 are all shown. The transition line 100, the exposed forefoot edge 98, the medial side 40, and the lateral side 38 collectively define the transition zone 102. In FIG. 6, the transition line 100 is farther away from the forward point 84 than the exposed forefoot edge 98 is from the medial side 40 to the lateral side 38 of the shoe 30. The plurality of spikes 70 including the first spike 106, second spike 108, third spike 110, and fourth spike 112 are shown being disposed along or within the bottom wall 82. In the present embodiment, the exposed forefoot edge 98 is not a straight line, but instead is a wavy line with two curves to accommodate the first spike 106 and the second spike 108. The wavy line defines three inflection points, but may define two, or four, or five, or six, or more inflection points. The first spike 106 is positioned on the lateral side 38 of the shoe 30 and adjacent to the exposed forefoot edge 98. The second spike 108 is positioned on the medial side 40 of the shoe 30 and adjacent to the exposed forefoot edge 98. The third spike 110 and the fourth spike 112 are positioned adjacent to the forward point 84. The fourth spike is 112 is closer to the lateral side 38 of the shoe 30 than the medial side 40 of the shoe 30 (see FIGS. 3, 4, and 6).

Still referring to FIG. 6, each of the plurality of spikes 70 has an embossment 118 that slightly projects from the bottom wall 82 and concentrically surrounds each of the plurality of spikes 70. In some embodiments, the plurality of spikes 70 have no corresponding embossment 118. In some embodiments, the embossment 118 can be circular, square, hexagonal, diamond, star or another shape. The embossment 118 does not project as far as any of the plurality of spikes 70. The bottom wall 82 also has the plurality of barbs 114 that project from the bottom wall 82 away from the upper 32 (see FIG. 1), but not as far as the projection of any of the plurality of spikes 70. Each of the plurality of barbs 114 has a generally circular cross section in a plane parallel to the bottom wall 82. In some embodiments, the bottom wall 82 may have a plurality of teeth (not shown) that project from the bottom wall 82 away from the upper 32, but not as far as the projection of any of the plurality of spikes 70. Each of the plurality of teeth has a generally oval cross section in a plane parallel to the bottom wall 82. The plurality of barbs 114 and/or the plurality of teeth, if present, are integrally formed with the bottom wall 82 of the sole plate 68. The plurality of barbs 114 and/or the plurality of teeth, if present, are configured to improve traction with the ground. In some embodiments, neither the plurality of barbs 114 nor a plurality of teeth are present. In some embodiments, the plurality of spikes 70 extend beyond the deepest point 94, and in some embodiments, the plurality of spikes 70 do not extend beyond the deepest point 94.

Referring to FIG. 7, the forefoot region 42 is shown in its entirety, along with a portion of the midfoot region 44. The exposed forefoot region 96 and the exposed forefoot edge 98 expose or uncover the bottom wall 82 of the sole plate 68. The forward point 84 and the deepest point 94 are both shown. The rounded front 78 is shown projecting toward the upper 32 (see FIG. 1) near the forward point 84. The plurality of barbs 114 and two of the plurality of spikes 70 are shown, namely the second spike 108 and the third spike 110. In addition, the main axis 90 projects from and intersects the forward point 84. An inclination line 120 intersects the deepest point 94 and the forward point 84 (see FIGS. 7 and 15). An inclination angle 122 is located at the forward point 84 and between the inclination line 120 and the main axis 90.

The inclination angle 122 provides a way to measure how much the shoe 30 is configured to facilitate an increase in the angle of inclination of the runner. Since the sole structure 34 (see FIG. 1) in the exposed forefoot region 96 is not as deep as the sole structure 34 in the midfoot region 44 and the outsole 64, the shoe 30 is structured to facilitate a runner tilting forward during a footstep. In other words, the structure and shape of the shoe 30 tends to increase the runner's angle of inclination. When the deepest point 94 is more forward in the midfoot region 44 and the exposed forefoot region 96 is reduced in size, the inclination angle 122 becomes larger. When the deepest point 94 is more rearward in the midfoot region 44 and the exposed forefoot region 96 is configured larger, the inclination angle 122 becomes smaller. The inclination angle 122 provides a way to manipulate the angle of inclination of the runner. The inclination angle 122 can be between about two and about 30 degrees, or between about three and about 20 degrees, or between about four and about 15 degrees, or between about five and about 10 degrees, or between about six and about eight degrees. The inclination angle 122 also provides an indication of the amount of exposed forefoot region 96 present. The lack of the outsole 64 and the midsole structure 66 in the exposed forefoot region 96 is also helpful in reducing losses during a footstep (see FIG. 9 and the discussion of FIG. 9 below).

Figure 8:
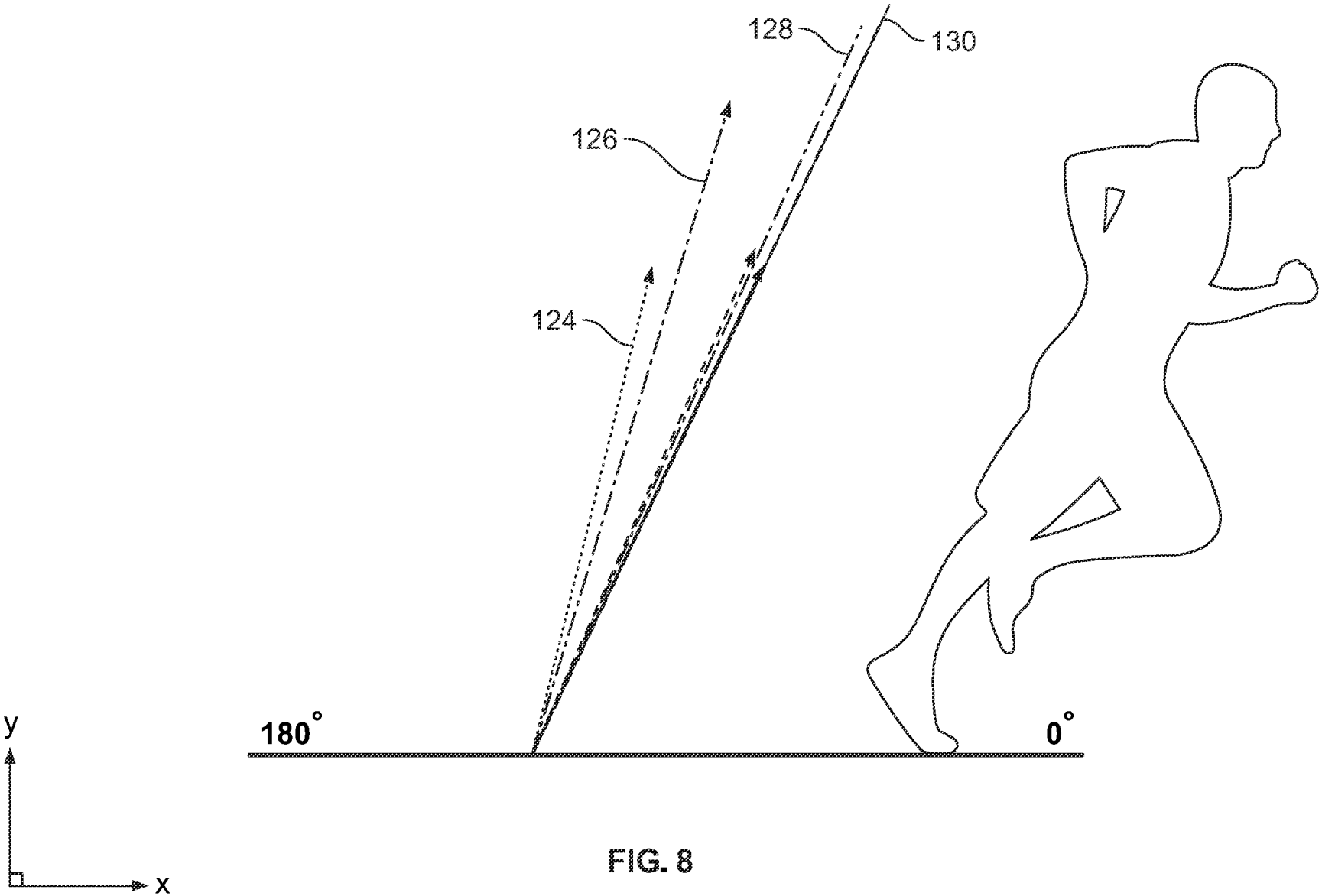
FIG. 8 is graph illustrating a group of runner's average force vector in the vertical and horizontal directions depending upon the specific group of runner's angle of inclination.

FIG. 8 is a graph illustrating a group of runner's average force vector in the vertical and horizontal directions, depending upon the specific group of runner's angle of inclination. Four groups of runners were observed and measured. A first group 124, a second group 126, a third group 128, and a fourth group 130 of runners, each respectively presented as force vector lines, represent groups of runners who were measured while running at different angles of inclination. For example, the first group 124 is a group of runners having a measured angle of inclination of 0.2 degrees. This means that the runners in the first group 124 leaned forward very little compared to the other groups 126, 128, 130 while running. The horizontal x axis represents the magnitude of horizontal force produced, and the vertical y axis represents the vertical force produced by the various groups 124, 126, 128, 130. The amount of horizontal force, i.e., moving forward, produced by the first group 124 was compared to the amount of vertical force, i.e., moving up and down, produced by the first group 124. This ratio of vertical force produced versus horizontal force produced is presented as the vector that represents the first group 124 in FIG. 8.

The second group 126 had a measured angle of inclination of 0.5 degrees, the third group 128 had a measured angle of inclination of 0.8 degrees, and the fourth group 130 had a measured angle of inclination of 1.1 degrees. This means that the second group 126 leaned forward more than the first group 124, but less than the third group 128 and the fourth group 130. For each group, the more the group leaned forward, the more horizontal force was produced compared to the amount of vertical force produced. As a result, the force vector for the first group 124 is the farthest to the left, and the force vector for the fourth group 130 is the farthest to the right in the graph of FIG. 8. This indicates that horizontal force, and therefore speed, was generated more efficiently as the runner's angle of inclination was increased. Therefore, the graph depicted in FIG. 8 supports the general conclusion that a runner with a higher angle of inclination generally runs more efficiently. The inclination angle 122 (see FIGS. 7 and 15) of the shoe 30 (see FIG. 1) provides a way to help increase the angle of inclination of a runner.

Figure 9:
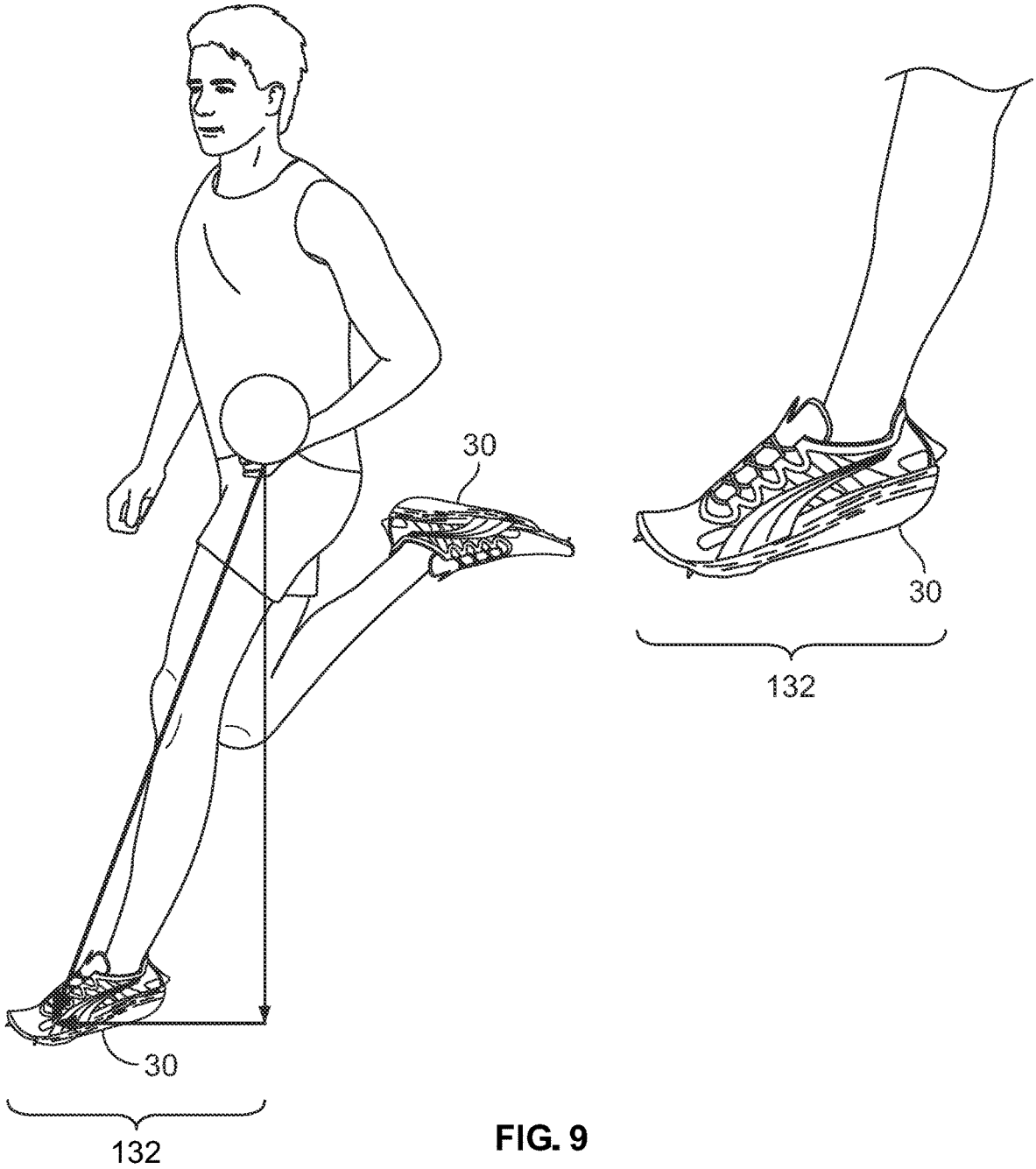
FIG. 9 is an image in a sequence of a runner during a first phase of a footstep.
Figure 10:
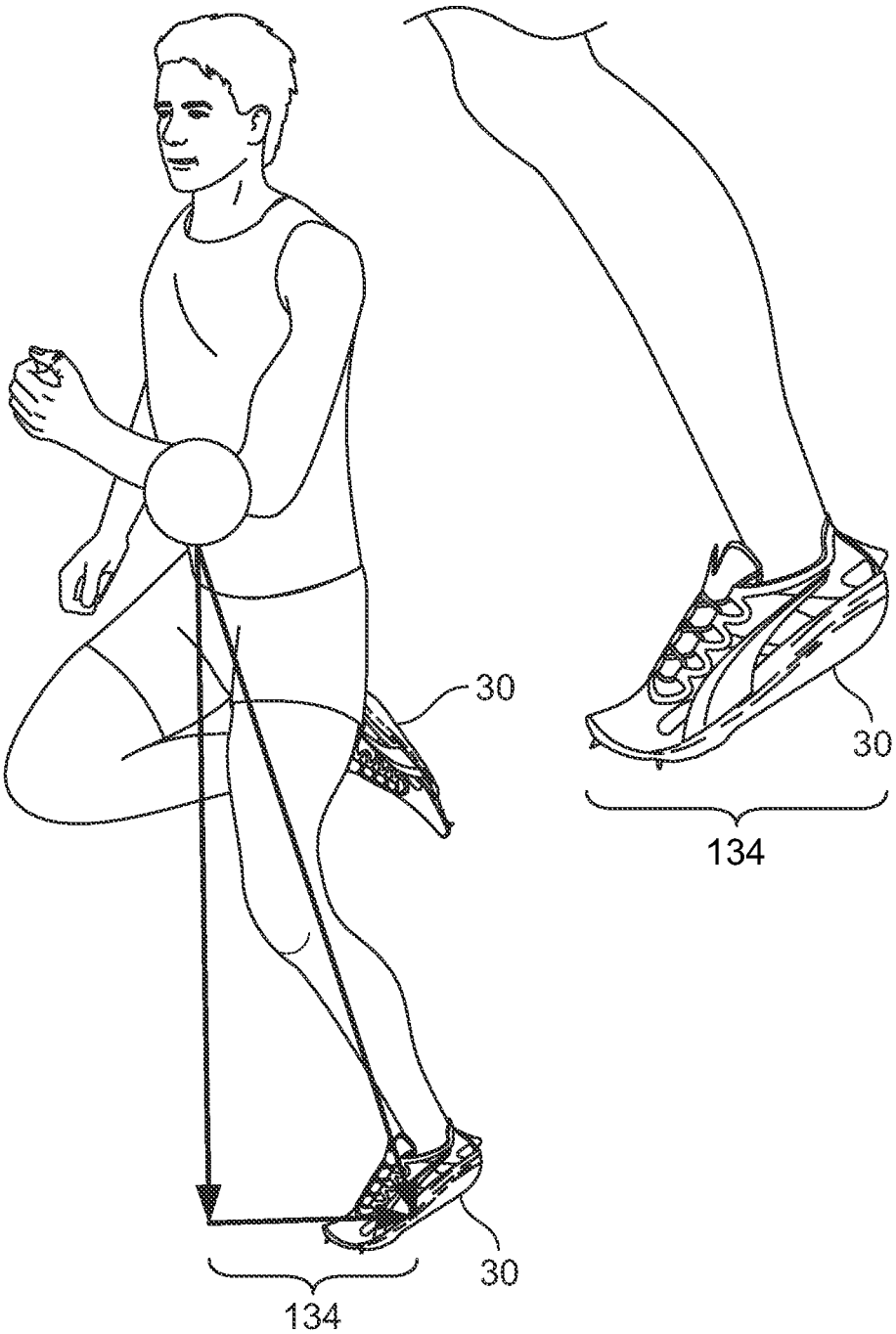
FIG. 10 is an image in a sequence of a runner during a second phase of a footstep.
Figure 11:
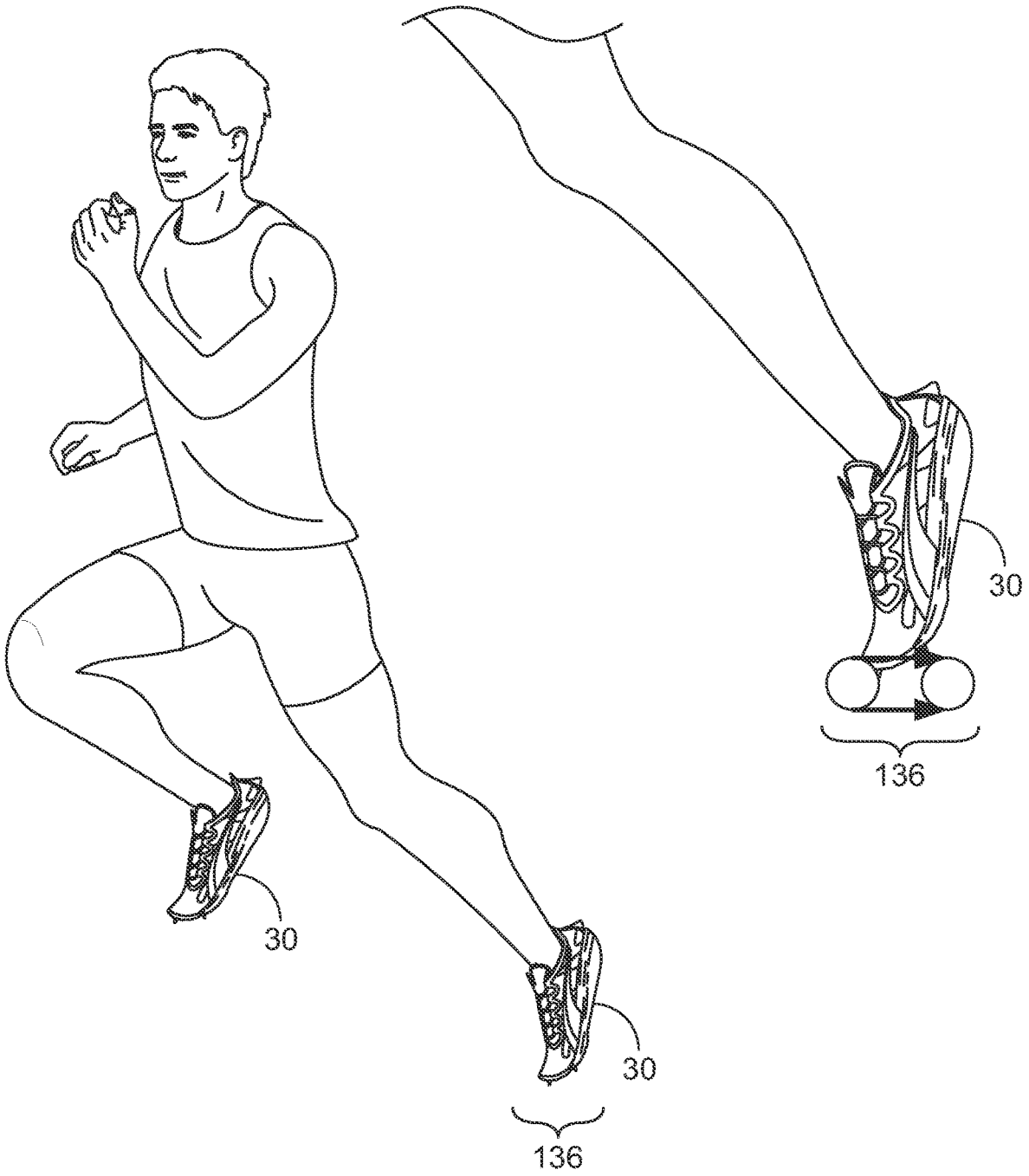
FIG. 11 is an image in a sequence of a runner during a third phase of a footstep.

FIGS. 9-11 illustrate a sequence of images of a runner during a first phase 132 (FIG. 9), a second phase 134 (FIG. 10), and a third phase 136 (FIG. 11) of a footstep. Referring to FIG. 9, the first or landing phase 132 shows a runner taking a footstep, and the shoe 30 has initial contact with the ground. When the shoe 30 contacts the ground initially, energy from the runner is spent compressing the shoe 30. The runner does not move faster in the horizontal direction during the first phase 132, but slows down instead. This slowdown reduces the runner's momentum. As a result, any configuration of the shoe 30 that can reduce this loss of energy during the first phase 132 will improve a runner's racing performance.

The article of footwear 30 of FIG. 1 has four features that reduce the amount of momentum lost from the first phase 132. First, the outsole 64 and the midsole structure 66 is absent from the exposed forefoot region 96, which reduces the amount of compression experienced by the midsole structure 66 and the outsole 64. Second, the sole plate 68 absorbs the majority of the first phase 132 as the shoe 30 contacts ground in the forefoot region 42. Since the sole plate 68 is comparatively rigid, the sole plate 68 springs back after compression. Much of the compression forces experienced by the sole plate 68 in the forefoot region 42 will be returned when the sole plate 68 springs back (see the discussion of the sole plate 68 material above in the discussion of FIGS. 1 and 2). Third, the inclination angle 122 (see FIGS. 7 and 15) of the shoe 30 facilitates the increase in the runner's angle of inclination. As noted with respect to FIG. 8 above, this increase in the runner's angle of inclination leads to less vertical force being wasted and more valuable horizontal forces being produced. Fourth, the plurality of spikes 70 in the forefoot region 42 (see FIG. 3) concentrate the forces of the first phase 132 to drive the plurality of spikes 70 securely into contact with the ground, thereby providing a stronger ground contact with the shoe 30 during the first phase 132. This driving of the plurality of the spikes 70 into secure contact with the ground will be beneficial in the later phases as well.

In FIG. 10, the second or propulsion phase 134 shows a runner taking a footstep, with the shoe 30 being in contact with the ground, and the runner being propelled forward with respect to the position of the shoe 30. The majority of the horizontal force, and therefore speed, produced during a footstep is during the second phase 134. Comparing FIG. 9 to FIG. 10, the shoe 30 begins the first phase 132 positioned in front of the body of the runner, but during the second phase 134 the shoe 30 ends positioned behind the body of the runner. The shoe 30 does not move from the first phase 132 to the second phase 134. Instead, the body of the runner moves forward in relation to the shoe 30. The body of the runner moves forward during the second phase 134 due to a combination of forward momentum and the additional horizontal force produced by the runner during the second phase 134. As a result, any configuration of the shoe 30 that increases the additional horizontal force during the second phase 134 improves a runner's performance.

The article of footwear 30 of FIG. 1 has several features that increase the additional horizontal force produced during the second phase 134 (see FIG. 10). First, the plurality of spikes 70 and the plurality of barbs 114 (see FIG. 3) ensure that the contact with the ground is strong, so that a runner can push as hard as the runner desires without losing traction. Second, the inclination angle 122 (see FIGS. 7 and 15) concentrates most of the second phase 134 contact into the exposed forefoot region 96 of the shoe 30, thereby reducing contact with the heel region 46 and the midfoot region 44. Since contact is reduced in the heel region 46 and the midfoot region 44, the amount of midsole structure 66 compressed is reduced. In addition, during this second phase 134 the sole plate 68 springs back to the original, pre-compression shape of the sole plate 68, and that energy is used to help propel the runner forward. Third, the inclination angle 122 also helps to facilitate the runner naturally having a higher angle of inclination during the second phase 134, which produces more valuable horizontal force and less wasted vertical force (see the discussion of FIG. 8 above). Fourth, because the bottom of the shoe 30 is effectively sloped due to the inclination angle 122, the stride of the second phase 134 is extended slightly at the end of the second phase 134, which provides more opportunity to produce more horizontal force.

Referring to FIG. 11, the third or toe off phase 136 shows a runner taking a footstep, and the shoe 30 is beginning to break contact with the ground. The runner is continuing to propel his body forward with respect to a position of the shoe 30 until the moment the shoe 30 breaks contact with the ground. Although the third phase 136 is a relatively short phase, the phase represents a great opportunity to maximize increasing the horizontal force produced during the footstep. When or if the shoe 30 loses traction with respect to the ground, energy can be lost. In addition, if the shoe 30 loses traction, the next footsteps of the runner may be affected due to a slight loss of balance, along with the loss of forward momentum. During a race where tenths of a second make a difference between first place and last place, a loss of traction of the shoe 30 during the third phase 136 could be that difference. As a result, maintaining good traction throughout the third phase 136 can greatly improve the performance of the runner.

The shoe 30 begins the second phase 134 (see FIG. 10) positioned behind the body of the runner, and during the third phase 136 the shoe 30 is still positioned behind the body of the runner. The shoe 30 remains in contact with the ground. Movement of the shoe 30 between the second phase 134 and the third phase 136 is related to a pivot or rotation of the shoe 30 as the shoe 30 rises up to break contact with the ground (see FIG. 11). As a result, any configuration of the shoe 30 that can help prevent a loss of traction during the third phase 136 and increase the horizontal force produced during the third phase 136 will improve a runner's racing performance.

The article of footwear 30 of FIG. 1 has several features that create good traction with the ground during the third phase 136 (see FIG. 11) and increase the horizontal force produced during the third phase 136. First, the plurality of spikes 70 and the plurality of barbs 114 (see FIG. 3) ensure that the contact with the ground is strong, so that a runner can push as hard as the runner wants with less fear of slipping and losing contact with the ground. Second, the inclination angle 122 (see FIGS. 7 and 15) concentrates most of the third phase 136 contact in the exposed forefoot region 96 of the shoe 30. The sole plate 68, during the third phase 136, either springs back to the original (pre-compression) shape of the sole plate 68, or already has sprung back, such that the plurality of spikes 70 are positioned as best as possible to maintain a strong contact with the ground. Third, the inclination angle 122 also helps facilitate the runner utilizing a higher angle of inclination during the third phase 136, which produces more valuable horizontal force and less wasted vertical force (see the discussion of FIG. 8 above).

Figure 12:
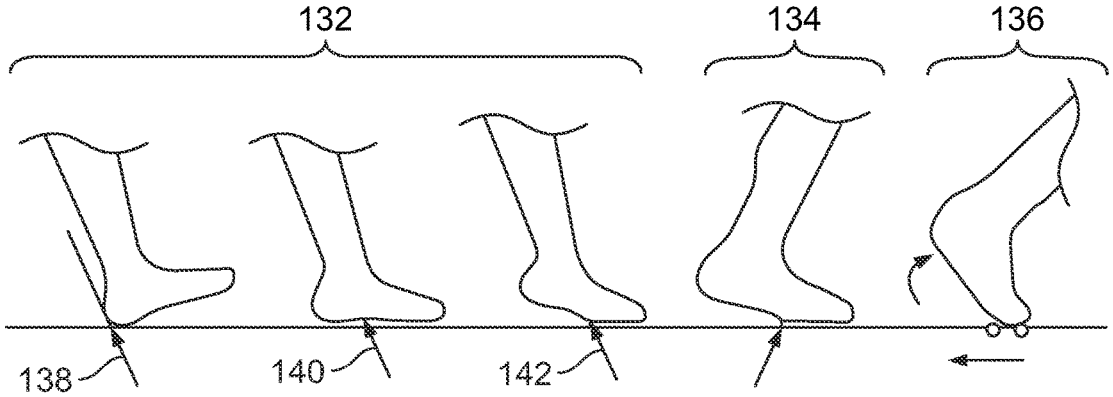
FIG. 12 illustrates various phases of a footstep being taken by a runner or walker.

FIG. 12 illustrates various phases of a footstep. The foot depicted in FIG. 12 is a generic foot, and is not the same as the shoe 30 of FIG. 1. The beginning of a first phase 132 for a runner running a race is different than the beginning of the first phase 132 for a walker doing slow paces during a leisurely stroll. An initial contact for slower speeds can be in a first or heel point 138. For faster speeds, the initial contact can be in a second or midfoot point 140, and for the fastest speeds, the initial contact can be in a third or forefoot point 142. This is, in part, about keeping balance for the runner. The faster a runner moves horizontally, the more that the runner can lean forward while maintaining their balance. However, at slower speeds, the horizontal force produced by the runner is reduced, and the angle of inclination of the runner is naturally reduced to maintain balance. Therefore, the initial contact for a fast-moving runner is generally farther forward in the foot than for a slower moving walker. The angle of the foot during the second phase 134 is shown, and reinforces that the body of the runner is behind the shoe 30 (and hence foot) during the first phase 132, but is in front of the shoe 30 during the later portion of the second phase 134. The foot begins to lift up vertically as the foot rotates during the third phase 136. Based on the orientation of the foot during the third phase 136, one or more spikes 70 (see FIG. 3) will improve the contact between the ground and the shoe 30 during the third phase 136.

Figure 13:
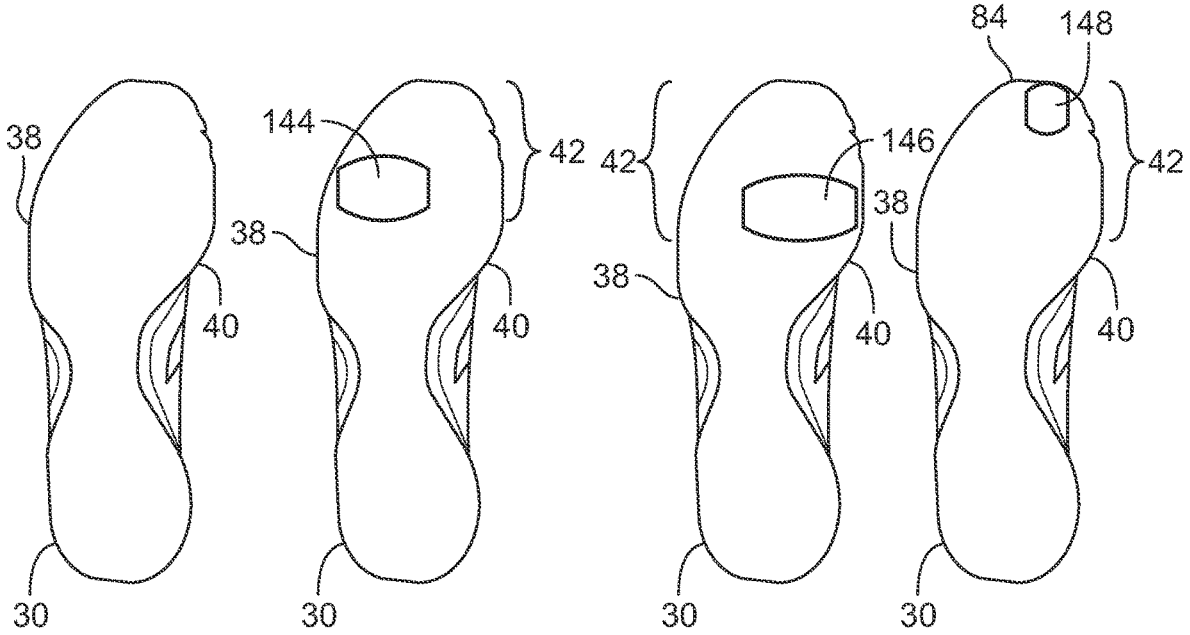
FIG. 13 illustrates various zones on the bottom of the shoe of FIG. 1 for the first, second, and third phases of a footstep.

FIG. 13 illustrates zones for the first phase 132 (see FIG. 12), the second phase 134 (see FIG. 12), and the third phase 136 (see FIG. 12) on the bottom of the (left) shoe 30 of FIG. 1. These zones collectively suggest where to locate each of the plurality of spikes 70 to create a desirable result. First, a landing zone 144 has been identified on the lateral side 38 of the forefoot region 42, where the first phase 132 has the most contact with the shoe 30. To ensure that the shoe 30 does not experience excessive traction (i.e., excessive braking forces) during the first phase 132, this landing zone 144 operates best by having fewer spikes present to provide enough traction to create enough contact with the ground during the first phase 132 without creating excessive traction or braking forces. Second, a propulsion zone 146 has been identified on the medial side 40 of the forefoot region 42, where the second phase 134 produces the most forward force. Traction in this propulsion zone 146 should be kept relatively high to ensure that the maximum horizontal force is produced during the second phase 134. This increased traction can be produced by having at least one of the plurality of spikes 70 present in the propulsion zone 146. Third, a contact zone 148 has been identified on the front of the forefoot region 42 near the forward point 84, where contact during the third phase 136 is most prevalent. Traction in this contact zone 148 should be kept relatively high to ensure that sufficient contact between the ground and the shoe 30 is maintained during the third phase 136, which again could otherwise reduce the horizontal force produced during the third phase 136. This increased traction can be produced by having at least one of the plurality of spikes 70 present in the contact zone 148.

Referring to FIGS. 3 and 13, based upon these findings, the location of the plurality of spikes 70 in at least one embodiment is directed to ensuring that the propulsion zone 146 and the contact zone 148 have plenty of traction, and that the landing zone 144 has sufficient traction during the first phase 132 without having an excessive amount of traction. The first spike 106 is positioned on the lateral side 38 of the shoe 30 and adjacent to the exposed forefoot edge 98. This location corresponds with the landing zone 144 of the first phase 132 discussed above. The first spike 106 provides enough traction to keep contact between the shoe 30 and the ground during the first phase 132 without creating an excessive amount of traction by placing too many of the plurality of spikes 70 in the landing zone 144. The second spike 108 is positioned on the medial side 40 of the shoe 30 and adjacent to the exposed forefoot edge 98. This corresponds with the propulsion zone 146 of the second phase 134 discussed above. The second spike 108 ensures that the propulsion zone 146 has sufficient traction to ensure that the second phase 134 can produce as much horizontal force as possible. The third spike 110 and the fourth spike 112 are positioned adjacent to the forward point 84. This corresponds with the contact zone 148 of the third phase 136 discussed above. The third spike 110 and the fourth spike 112 provide as much traction as possible to help create a strong contact between the shoe 30 and the ground during the third phase 136 to provide as much horizontal force as possible.

Figure 14:
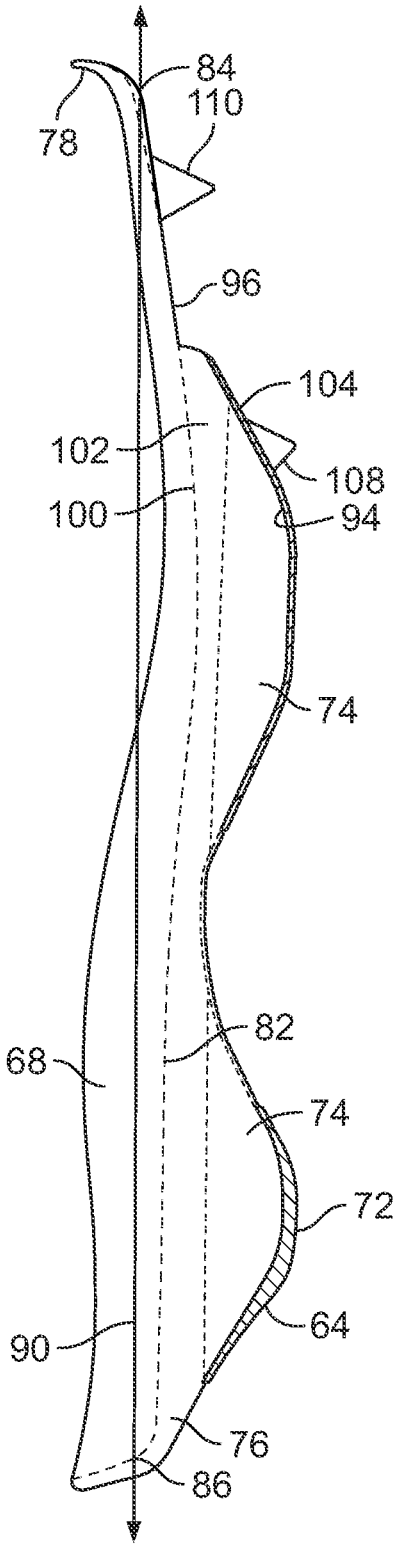
FIG. 14 is a cross section taken through line 14-14 of FIG. 3.
Figure 15:
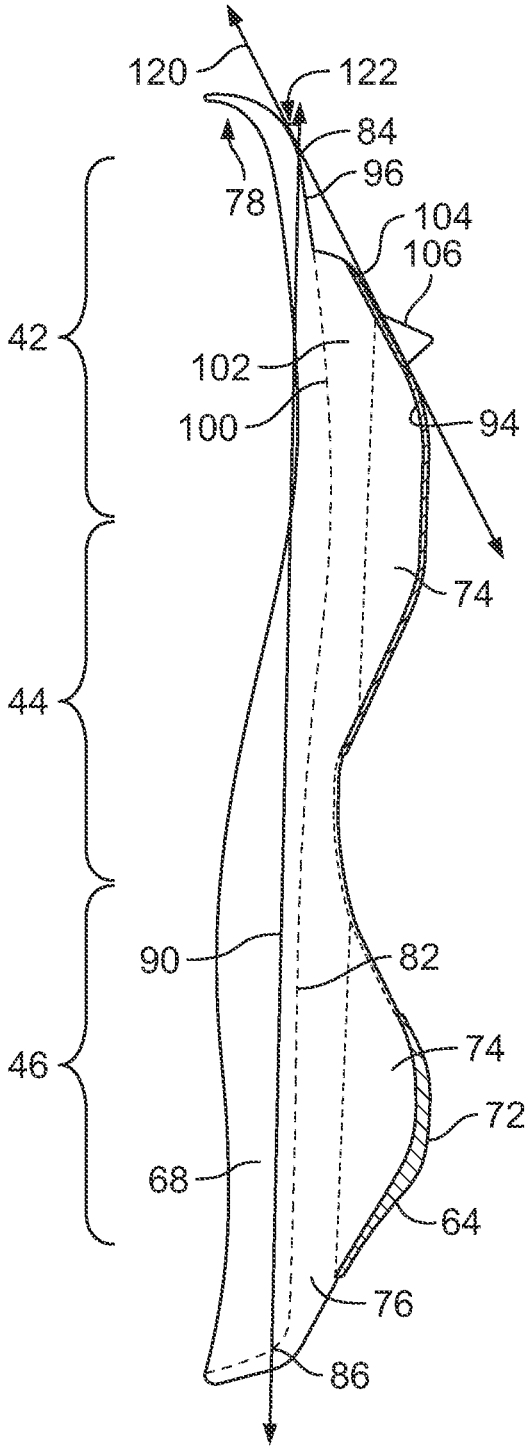
FIG. 15 is a cross section taken through line 15-15 of FIG. 3.

FIG. 14 is a cross section taken through line 14-14 of FIG. 3, and FIG. 15 is a cross section taken through line 15-15 of FIG. 3. Both FIGS. 14 and 15 show the bottom wall 72, the outsole 64, the first midsole member 74, the second midsole member 76, the sole plate 68, the bottom wall 82 of the sole plate 68, the rounded front 78, as well as the forefoot region 42, the midfoot region 44, the heel region 46 (see FIG. 15 for the latter three elements), and the exposed forefoot region 96. In addition, FIGS. 14 and 15 show the forward point 84, the rearward point 86, the deepest point 94, the undulation portion 104 and the transition zone 102. Further, the main axis 90, the transition line 100 (for a better view, see FIG. 6), the inclination line 120 (see FIG. 15) and the inclination angle 122 (see FIG. 15) are also shown. FIGS. 14 and 15 also show that the deepest point 94 is not necessarily the lowest point, but depending upon the shape of the slope of the transition zone 102 may be a shorter point that is unobstructed by the first midsole member 74, the second midsole member 76, or the outsole 64. The second spike 108 and the third spike 110 are shown in FIG. 14, and the first spike 106 is shown in FIG. 15. The fourth spike 112 has been removed in FIG. 15 to provide more clarity to the inclination angle 122 (see FIG. 3 for a clearer view of all four spikes 106, 108, 110, 112).

FIGS. 14 and 15 collectively show how the location of the plurality of spikes 70 in the exposed forefoot region 96 and the inclination angle 122 (see FIG. 15) are helpful for producing the advantages that the shoe 30 can provide. A runner during a race may lose less energy during the first phase 132 (see FIG. 9), and gain more energy or speed during the second phase 134 (see FIG. 10) wearing the shoe 30 disclosed herein as a result of an increased angle of inclination facilitated by the inclination angle 122 (see FIG. 15), the location of the plurality of spikes 70, and the spring back features of the sole plate 68 (see FIG. 3). In addition, the location of the plurality of spikes 70 will assist in providing a way to produce more horizontal power during the third phase 136 (see FIG. 11). Also, the reduction of the midsole structure 66 and the outsole 64 in the exposed forefoot region 96 reduces the weight of the shoe 30 as well. For all of these reasons, all of the embodiments of the shoe 30 disclosed herein provide for improvements in running performance during races.

Any of the embodiments described herein may be modified to include any of the structures or methodologies disclosed in connection with different embodiments. Further, the present disclosure is not limited to articles of footwear of the type specifically shown. The aspects of the articles of footwear of any of the embodiments disclosed herein may be modified to work with any type of footwear, apparel, or other athletic equipment.

As noted previously, it will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

INDUSTRIAL APPLICABILITY

Numerous modifications to the present invention will be apparent to those skilled in the art in view of the foregoing description. Accordingly, this description is to be construed as illustrative only and is presented for the purpose of enabling those skilled in the art to make and use the invention. The exclusive rights to all modifications which come within the scope of the appended claims are reserved.

We claim:

1. A sole structure for an article of footwear having an upper, a forefoot region, a midfoot region, a heel region, a medial side, and a lateral side, further comprising:

an outsole having an outer wall located along an exterior of the outsole and the exterior of the outsole being configured to be a ground-engaging surface;

a sole plate configured to be positioned adjacent the upper, the sole plate having a bottom wall, a forward end, an exposed forefoot region, a front, and a plurality of spikes; and a midsole structure positioned between the sole plate and the outsole, wherein the forward end is located at a point in the forefoot region farthest away from the heel region, wherein the front is located at the forward end, wherein a forward point is located along the bottom wall at the front, wherein a rearward point is located along the bottom wall and farthest away from the forward point, wherein a main axis line is defined as a line that intersects the forward point and the rearward point, wherein the exposed forefoot region is located in the forefoot region and is not covered by the outsole or the midsole structure, wherein the outer wall has a deepest point in the midfoot region, wherein the deepest point is defined as a point that forms a largest angle between the main axis line and an inclination line, the inclination line is defined as a line that intersects the forward point and a point on the outer wall that is not obstructed by the midsole structure or the outsole, wherein an inclination angle is defined as an angle formed between the main axis line and the inclination line, wherein the inclination angle is between two and 30 degrees, and wherein the ground-engaging surface of the outsole in the midfoot region is spaced apart and separate from the ground-engaging surface of the outsole in the heel region on each of the medial side and the lateral side of the sole structure.

2. The sole structure of claim 1, wherein the inclination angle is between three and 20 degrees.

3. The sole structure of claim 1, wherein the inclination angle is between four and 15 degrees.

4. The sole structure of claim 1, wherein the inclination angle is between five and 10 degrees.

5. The sole structure of claim 1, wherein the inclination angle is between six and eight degrees.

6. A sole structure for an article of footwear having an upper, a forefoot region, a midfoot region, a heel region, a medial side, and a lateral side, further comprising:

an outsole having an outer wall located along an exterior of the outsole and the exterior of the outsole being configured to be a ground-engaging surface;

a sole plate configured to be positioned adjacent to the upper, the sole plate having a bottom wall, a forward end, an exposed forefoot region, a front, and a plurality of spikes; and a midsole structure positioned between the sole plate and the outsole, wherein the exposed forefoot region is located in the forefoot region and is not covered by the outsole or the midsole structure, wherein the plurality of spikes are located in the exposed forefoot region, wherein an exposed forefoot edge defines an edge between the exposed forefoot region and the midsole structure or the outsole, wherein at least one of the plurality of spikes is located adjacent to the medial side and the exposed forefoot edge, wherein at least one of the plurality of spikes is located adjacent to the lateral side and the exposed forefoot edge, wherein at least one of the plurality of spikes is located adjacent to a forward point, wherein the exposed forefoot edge includes at least two inflection points, and wherein a portion of the sole plate in the forefoot region is directly exposed to a ground surface when the sole structure is resting on the ground surface.

7. The sole structure of claim 6, wherein the plurality of spikes has a first spike, a second spike, a third spike, and a fourth spike.

8. The sole structure of claim 7, wherein the third spike, and the fourth spike are located adjacent to the forward point.

9. The sole structure of claim 6, wherein the exposed forefoot region has a plurality of barbs, wherein each of the plurality of barbs is shorter than each of the plurality of spikes, and wherein the plurality of barbs includes a circular cross section in a plane parallel to the bottom wall.

10. The sole structure of claim 6, wherein the front projects away from the bottom wall and toward the upper.

11. The sole structure of claim 6, wherein each of the plurality of spikes has an embossment that projects from the bottom wall and concentrically surrounds each of the plurality of spikes.

12. The sole structure of claim 6, wherein the midfoot region or the heel region has a cutout portion where the bottom wall is not covered by the midsole structure or the outsole.

13. A sole structure for an article of footwear having an upper, a forefoot region, a midfoot region, a heel region, a medial side, and a lateral side, further comprising:

an outsole having an outer wall located along an exterior of the outsole and the exterior of the outsole being configured to be a ground-engaging surface;

a sole plate configured to be positioned adjacent to the upper, the sole plate having a bottom wall, a forward end, an exposed forefoot region, a front, and a plurality of spikes, and a midsole structure including a first midsole member and a second midsole member, the midsole structure extending between the midfoot region and the heel region, wherein the exposed forefoot region is located in the forefoot region and is not covered by the outsole or the midsole structure, wherein an exposed forefoot edge defines an edge between the exposed forefoot region and the midsole structure or the outsole, wherein the forward end is located at a point in the forefoot region farthest away from the heel region, wherein the front is located at the forward end, wherein a forward point is located along the bottom wall and at the front, wherein a rearward point is located along the bottom wall and farthest away from the forward point, wherein a main axis line is defined as a line that intersects the forward point and the rearward point, wherein the outer wall has a deepest point in the midfoot region, wherein the deepest point is defined as a point that forms a largest angle between the main axis line and an inclination line, the inclination line is defined as a line that intersects the forward point and a point on the outer wall that is not obstructed by the midsole structure or the outsole, wherein a transition line is located along the bottom wall, projecting perpendicularly with respect to the main axis line, extends from the lateral side to the medial side, and closest to the deepest point, wherein an undulating portion is defined as a region bounded by the transition line and the exposed forefoot edge, extending from the medial side to the lateral side, wherein the sole structure within the undulating portion slopes toward the bottom wall, wherein the first midsole member is in direct contact with the outsole in the heel region and the second midsole member is in direct contact with the sole plate, and wherein the first midsole member is disposed entirely below the second midsole member in the heel region when the article of footwear is resting on a ground surface.

14. The sole structure of claim 13, wherein the front projects away from the bottom wall and toward the upper.

15. The sole structure of claim 13, wherein the exposed forefoot edge is a wavy and continuous line.

16. The sole structure of claim 13, wherein the plurality of spikes are integrally formed with the sole plate.

17. The sole structure of claim 13, wherein the plurality of spikes includes a first spike, a second spike, a third spike, and a fourth spike.

18. The sole structure of claim 17, wherein the first spike is located adjacent to the exposed forefoot edge and the lateral side, and the second spike is located adjacent to the exposed forefoot edge and the medial side.

19. The sole structure of claim 18, wherein the third spike and the fourth spike are located adjacent to the forward point.

20. The sole structure of claim 19, wherein an inclination angle is defined as an angle formed between the main axis line and the inclination line, and wherein the inclination angle is between 2 and 30 degrees.

* * * * *